United States Patent [19]

Hemphill

[11] Patent Number: 4,507,924

[45] Date of Patent: Apr. 2, 1985

[54] SYSTEM FOR EFFICIENTLY CONVERTING HYDROCARBONS INTO POWER

[76] Inventor: Charles W. Hemphill, 1106 Green Valley La., Duncanville, Tex. 75116

[21] Appl. No.: 368,541

[22] Filed: Apr. 15, 1982

[51] Int. Cl.[3] ..... F02B 71/04

[52] U.S. Cl. ..... 60/595; 60/418; 60/431; 417/11

[58] Field of Search ..... 60/325, 396, 431, 433, 60/418, 595, 596, 413; 417/11, 34, 380

[56] References Cited

U.S. PATENT DOCUMENTS

| | | | |
|---|---|---|---|
| 2,978,986 | 4/1961 | Carder et al. | 60/596 X |
| 3,722,481 | 3/1973 | Braun | 60/596 X |
| 4,326,380 | 4/1982 | Rittmaster et al. | 417/380 X |

*Primary Examiner*—Stephen F. Husar
*Attorney, Agent, or Firm*—Marcus L. Bates

[57] ABSTRACT

The system of this disclosure provides apparatus by which fossil fuel is utilized in the generation of power. The generated power is more efficiently utilized by the apparatus. The system includes an internal combustion process which moves a piston. The piston is directly connected to actuate a special hydraulic pump which provides power fluid to an improved hydraulic motor. Each component of the system is specifically designed respective to the other components of the system to complement one another in a manner to effect an increase in efficiency, and therefore the efficiency gained from each component is added to the efficiency gained by the other components, all of which results in an accumulative gain in power from the total system.

44 Claims, 27 Drawing Figures

SYSTEM FOR EFFICIENTLY CONVERTING HYDROCARBONS INTO POWER

BACKGROUND OF THE INVENTION

The rapid depletion of our known fossil fuel reserves is inversely proportional to the cost of fuel for the internal combustion engine. Accordingly, our affluent society is already faced with an exorbitant fuel price structure which recently was abruptly thrust upon the world. This escalation in hydrocarbon cost has created a frantic activity toward alternate sources of energy and the more efficient use of our remaining fuel supply. Historically, it is world-wide dilemma of this sort that creates the necessity for change and improvement.

The practical internal combustion engine is a relatively recent innovation. The internal combustion engine is notoriously inefficient in its ability to convert fuel into mechanical energy. The most prolific user of fossil fuel is the highly inefficient internal combustion engine which was originated and developed during an abundance of hydrocarbon fuel which heretofore was available at affordable prices; and consequently the gratifying results produced by the internal combustion engine, along with low fuel cost, negated any effort towards achieving significient increased fuel efficiency. Most internal combustion engines manufactured today use the old basic concept of producing rotatory mechanical movement from reciprocatory motion, as the result of the expansion of a combusted air and fuel mixture contained within a closed cylinder. An inherent drawback of this ancient design is that only a small portion of power available from the combustion process is converted into mechanical energy. Recently industry has invested significant effort and money towards improving the efficiency of these engines, however these efforts are primarily directed toward improving the efficiency of the ancilliary components of the engine; that is, fuel flow and combustion mixture, ignition, flame propagation, valve timing, and the like. Many internal combustion engine experts consider it impossible to achieve an efficiency significantly above the present 30 percent level, which is accomplished only when operating the engine under optimum conditions. Accordingly, regardless of the improvements effected into the ancilliary components of a crankshaft type engine, a further significant increase in efficiency cannot be achieved with this present internal combustion engine.

The internal combustion process appears to be the most logical manner of producing mechanical energy from hydrocarbons, and this has been amply demonstrated by the crankshaft type internal combustion engine presently in use. Therefore, it appears that in order to significantly increase the efficiency of a combustion engine, further utilization of the available energy from each power stroke of a combustion process must be converted into mechanical energy, rather than wasted in the form of exhaust gases, friction, and waste heat. An engine which achieves this desirable result is the subject of the present invention.

A significant increase in efficiency from the combustion process occurs by precisely metering the air and fuel to provide a stoichiometric combustion mixture, thereby providing the maximum available temperatures, because the expansive force against the engine piston is directly proportional to the temperature of the combustion gases. Accordingly, the present invention includes means by which a precisely controlled fuel to air ratio is achieved.

Theoretically, the available work resulting from the placement of an optimum air-fuel mixture of known quantity within a cylinder of a given size, having a piston properly positioned to commence the power stroke, can be calculated to ascertain the maximum energy available from the piston at all positions of the power stroke. It is known that immediately after ignition of the combustion mixture, the maximum pressure is developed within the combustion chamber. As the piston continues to move, the expansion of the combustion gases provide a steadily decreasing force, or pressure differential, across the piston. Since this pressure differential is proportional to the combustion chamber pressure, and since the combustion chamber pressure is steadily declined as the piston is stroked, the energy available from harnessing the movable piston likewise declines as the piston approaches the end of the power stroke. Accordingly, it would appear advantageous to be able to extract the declining energy available from the piston by providing an energy accumulating opposing force of a correspondingly steadily declining nature which corresponds to the force generated by the moving piston, thereby capturing substantially all of the available energy from the process.

Mobile vehicles, such as the automobile, operate under an infinite number of speed and load conditions. Variation in speed or load requirements is accomplished by changing the internal combustion process proportional to power demand or desired performance, and not according to fuel efficiency. Slow speeds, or low power demands, is accomplished by placing a small fraction of the optimum fuel charge into each of the combustion chambers. Higher speed or greater load requirements is satisfied by allowing the combustion process to be carried out with a much greater than optimum fuel charge, and accordingly there are very few speeds or conditions of operation which represent an efficient utilization of available energy.

In a crankshaft type internal combustion engine, the resultant forces of the reciprocating piston is transmitted by the connecting rod into the rotating crankshaft at varying degrees of oblique angles in order that reciprocatory motion may be changed into rotary mechanical motion. The resultant forces are transmitted at an extreme mechanical disadvantage. Moreover, this configuration between the piston and the crankshaft precludes the provision of a corresponding, uniform, declining, energy receiving, opposing force referred to above.

Accordingly, the greatest impediment to implementing significant increase in the efficiency of the crankshaft type internal combustion engine lies between the thermal process and the mechanical process. Therefore, any significant improvement would appear to require that the internal combustion process be actuated intermediately in a manner to maintain a level of available power which always equals or more nearly matches the varying power demand. This entails separation or isolation of the combustion process from any direct mechanical connection in a power train. Accomplishment of this separation requires that a transfer medium be provided between the energy producing and the energy consuming portions of the system. Ideally, the transfer medium must be able to absorb substantially all of the energy developed by the combustion process, regardless of its intensity or rate. Accordingly, the medium must provide a means of extracting energy from the moving piston, whereby each power stroke is opposed by a force which closely approximates the available power during the engine power stroke. The transferred medium can be either electric or hydraulic; and, since anything, or most anything that is accomplished hydraulically can be duplicated electrically, the present disclosure revolves about a specific hydraulic principle of operation with it being understood that those skilled in the art can also relate the teachings herein to electrical principle of operation.

The above concept enables a hydraulic oil accumulator to be used as the transfer medium. The accumulator receives varying quantities of energy, and stores the excess energy, so that there is no unused or wasted energy from the combustion process.

SUMMARY OF THE INVENTION

A power system which includes an improved internal combustion engine, hydraulic pump, hydraulic motor, and means providing a constant air-fuel mixture to the combustion chamber of the engine, all connected together to provide a new combination, in accordance with the present invention. The hydraulic motor of this invention receives power fluid from an accumulator, and the accumulator is also connected to actuate a novel air pump and fuel pump. The air pump and fuel pump combination are connected to deliver compressed air and fuel to the combustion chambers of the internal combustion engine upon command.

An operating mechanism coordinates the various valves, switches, and firing mechanism for the power system, and includes an engine restart apparatus for combustion failure.

The internal combustion engine includes pistons connected to a linearly reciprocating shaft which is connected to the hydraulic pump to cause the pump pistons to reciprocate linearly in response to engine piston movement. The power fluid generated by the hydraulic pump is connected to the accumulator, and the operating mechanism causes the internal combustion engine to reciprocate only when the accumulator pressure falls below a predetermined selected value.

The restart apparatus includes means by which the accumulator pressure is restored to a minimum value, and further includes means by which the internal combustion engine is stroked into proper position for combustion to commence, thereby commencing the operation of the entire system.

The air pump includes a variable chamber and piston combination which compresses air in a non-linear manner so that as hydraulic pressure forces the piston to compress the air within the compression chamber thereof, mechanical advantage is achieved between the piston and the piston chamber, thereby extracting the maximum available work from the hydraulic fluid.

The hydraulic motor includes a rotor having a plurality of radial vanes. The rotor has a power output shaft which can be connected to most any load. The rotor and vanes are positioned within a variable chamber which enables an infinite volumetric change to be selectively achieved by moving the stators towards and away from one another in order that the volume of the chamber may be changed.

Accordingly, a primary object of the present invention is the provision of a power conversion system which includes the combination of an internal combustion engine, hydraulic pump, air and fuel pump, and hydraulic motor which cooperate together in a unique manner which maximizes the efficiency of operation in a manner heretofore unknown.

Another object of the present invention is the provision of a combination internal combustion engine and hydraulic pump assembly which consumes fuel upon power fluid demand and which can remain in the standby configuration at all other times.

A further object of this invention is the provision of an internal combustion engine in combination with an air pump, fuel pump, and hydraulic pump for providing power fluid for a hydraulic motor.

A still further object of this invention is the provision of an operating mechanism for an internal combustion engine and hydraulic pump combination wherein the pump has means associated therewith which causes the internal combustion engine to be recycled to the starting position upon combustion failure.

Another and still further object of the present invention is the provision of an operating mechanism by which the combination of an internal combustion engine, hydraulic pump, hydraulically acutated motor, air pump, fuel pump, and ignition system are efficiently connected together into a unique single system of operation so that the hydraulically actuated motor is provided with a constant supply of power fluid commensurate with power demand.

An additional object of the present invention is the provision of a hydraulically actuated motor having a vaned type rotor operatively supported within a housing which provides a variable chamber within which the vanes rotate so that the speed and power output of the motor can be varied over an infinite range.

Still another object of the present invention is the provision of a hydraulic motor having a rotor with radial vanes which operates within a variable chamber, and which can be varied from a substantially circular configuration into an elliptical configuration.

Another object of the present invention is the provision of a power system which includes the combination of an internal combustion engine connected to reciprocate a hydraulic pump for providing a source of hydraulic pressure which operates an air pump, fuel pump, and hydraulic motor.

An additional object of the present invention is the provision of an operating mechanism controllably connected for operating an internal combustion engine; the air supply, ignition, and fuel supply therefor; and, which restarts or resets the internal combustion engine upon misfire, and which initiates the combustion process.

A still further object of this invention is the provision of an internal combustion engine of the double acting linear type in combination with a hydraulic pump, air pump, fuel pump, and recycling apparatus, all of which cooperated together to provide a source of power fluid for a hydraulic motor.

These and various other objects and advantages of the invention will become readily apparent to those skilled in the art upon reading the following detailed description and claims, and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENTS

Figure 1:
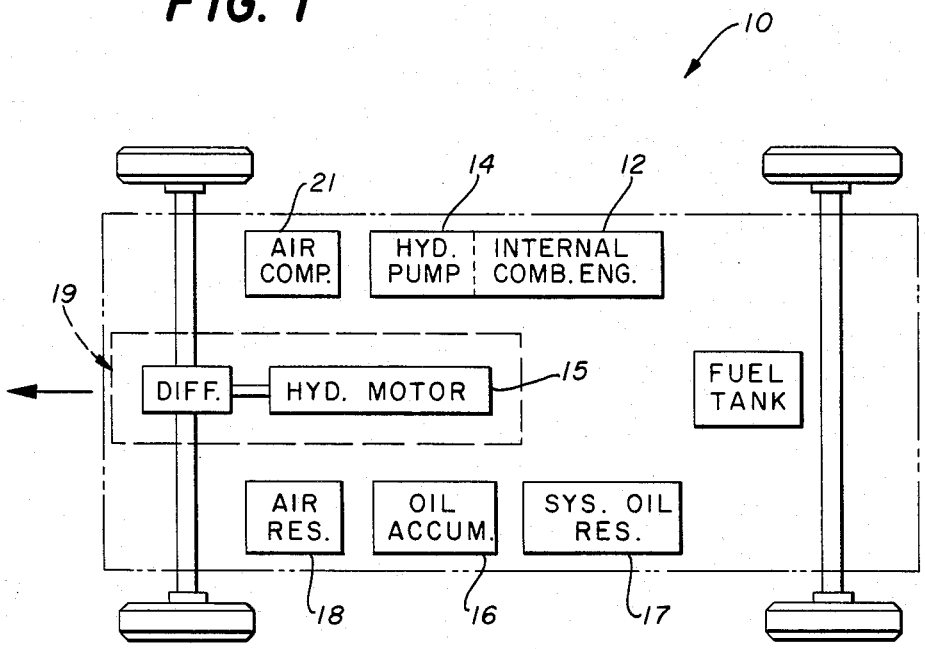
FIG. 1 is a part diagrammatical, part schematical, illustration of a vehicle having a power system made in accordance with the present invention.

In FIG. 1 of the drawings, there is diagrammatically illustrated a vehicle 10 having apparatus associated therewith made in accordance with the present invention, and which includes an internal combustion engine 12, hydraulic pump 14, hydraulic motor 15, oil accumulator 16, system oil reservoir 17, an air compressor and air reservoir 18, and a fuel tank, all connected together to provide the unique power system of the present invention. The power system is connected to a differential 19 of the vehicle, and could equally well be connected to drive most anything.

Figure 2:
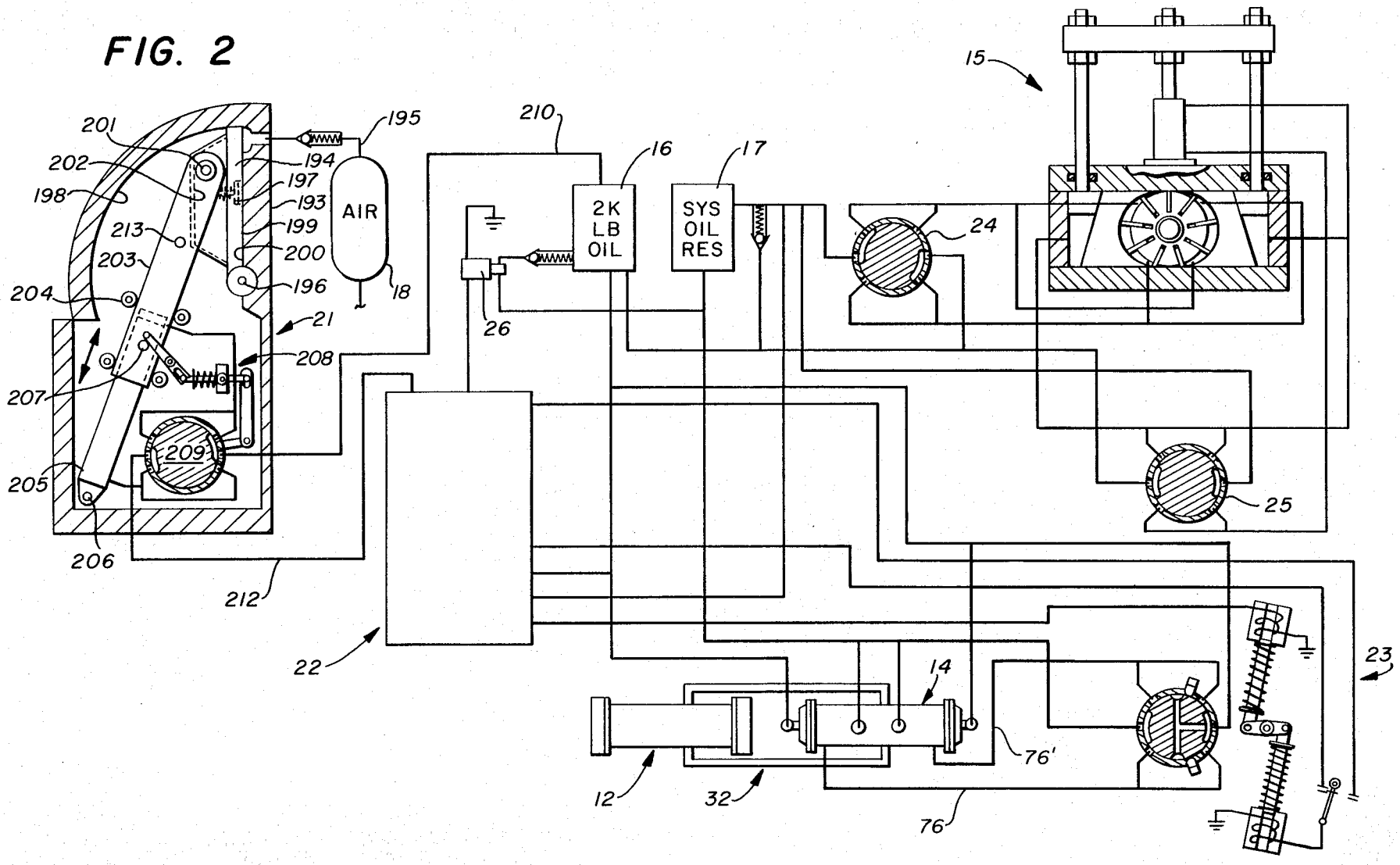
FIG. 2 is a part diagrammatical, part cross-sectional, detailed view of the power system of FIG. 1.

In FIG. 2 of the drawings, there is disclosed the before mentioned air reservoir 18, which is shown connected to receive compressed air from the hydraulically actuated air compressor 21. The air compressor, along with the hydraulic motor and hydraulic pump, is operatively connected by the illustrated flow conduits to an operating mechanism 22. The operating mechanism includes restarting or reset apparatus 23 for initiating operation, or for correcting combustion failure, the details of which will be more particularly pointed out later on in this disclosure.

Valve 24 is connected to the illustrated flow conduits and controls the direction of rotation of the hydraulic motor 15, while valve 25 is arranged to control the speed of the motor. An electric motor 26 is operatively connected to the schematically illustrated hydraulic pump for providing power oil at 16 upon demand. A pair of pressure actuated switches, 27 and 28 of FIG. 4, are connected to be actuated by the hydraulic pressure contained within accumulator 16.

Figure 3:
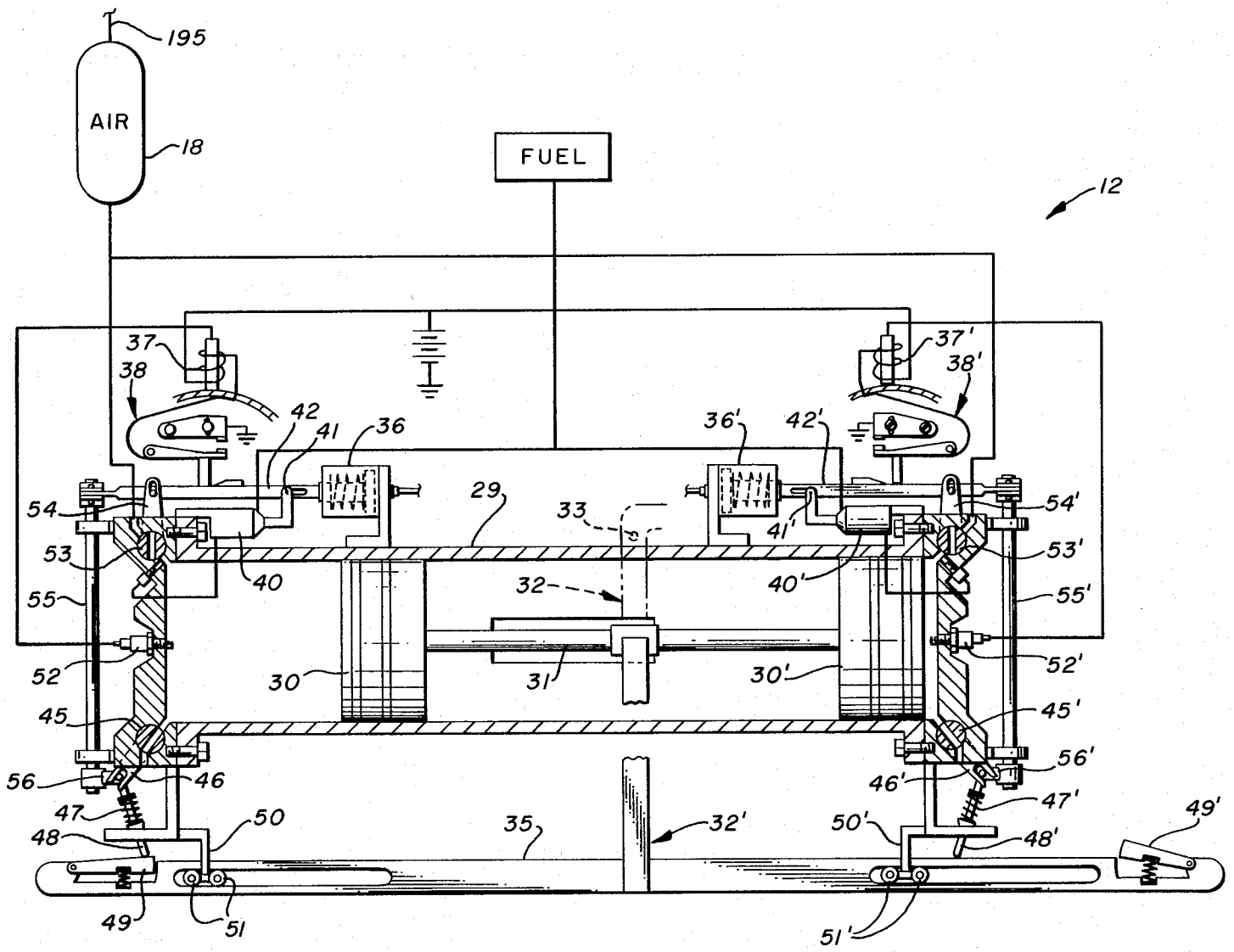
FIG. 3 is a part diagrammatical, part schematical, broken, enlarged, cross-sectional view taken along line 3—3 of FIG. 5.

As particularly set forth in FIG. 3, the internal combustion engine 12 is seen to have a cylinder 29 which reciprocatingly receives spaced pistons 30 and 30' therewithin. The pistons are connected together by a connecting rod 31, while a yoke, 32 and 32', is affixed to a medial portion of the connecting rod and extends through the illustrated slot formed in opposite side of a medial portion, or the connecting portion, of the cylinder wall. The yoke includes an actuator pin 33 which, as best seen illustrated in FIG. 4, actuates a control rod 34. The control rod is reciprocatingly mounted in low friction relationship respective to the cylinder 29.

A lower control rod 35, seen in FIG. 3, is reciprocatingly actuated by the yoke member 32'. Hydraulic cylinders 36 and 36' are mounted in close proximity to the engine cylinder and include pistons therewithin which are actuated by hydraulic pressure and which are connected to the illustrated flow lines. High tension ignition coils 37 and 37' are energized by the breaker point assemblies 38 and 38'.

Figure 4:
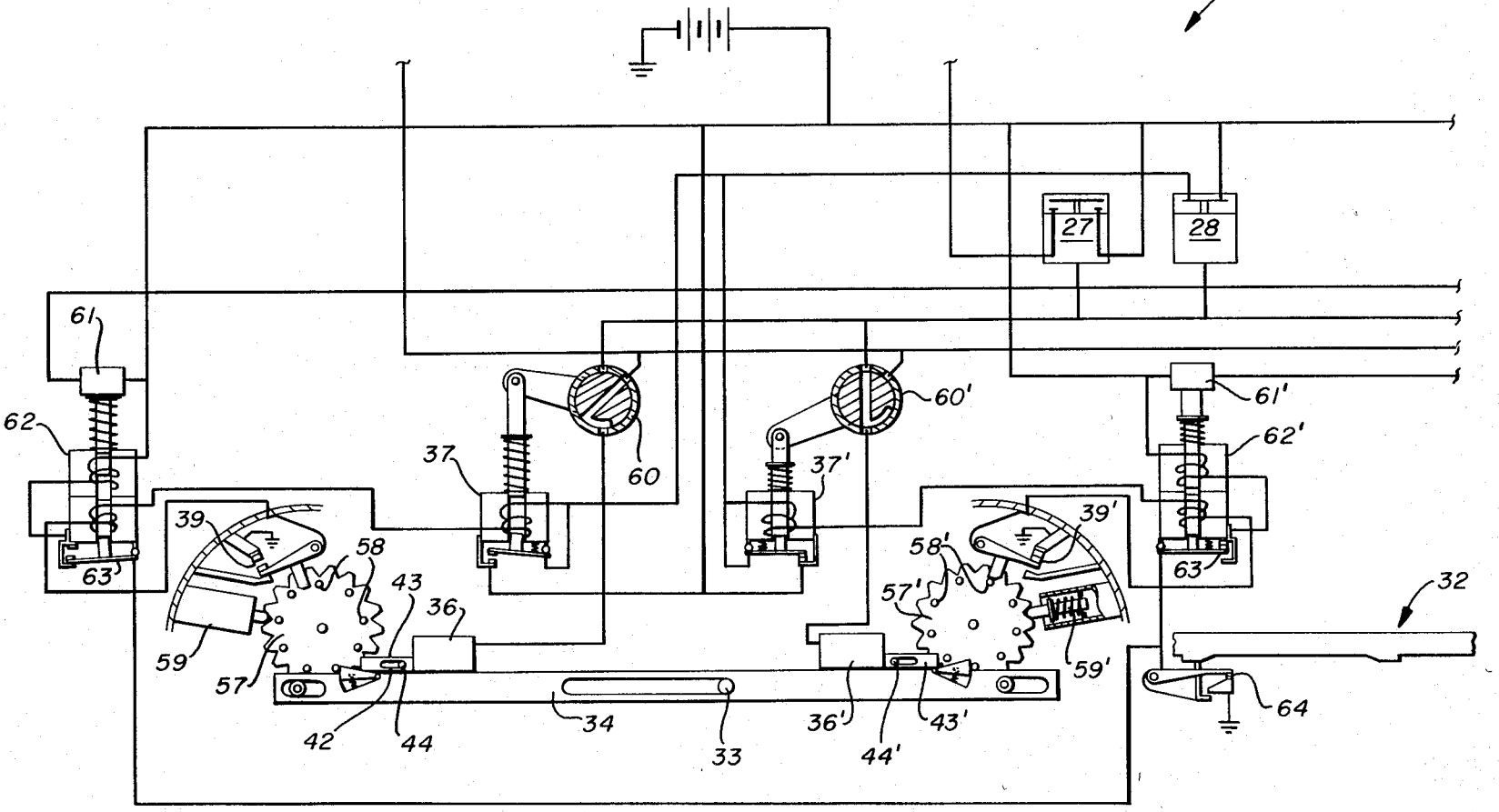
FIG. 4 is a part diagrammatical, part schematical, broken, enlarged view of another part of the apparatus disclosed in FIG. 2.
Figure 5:
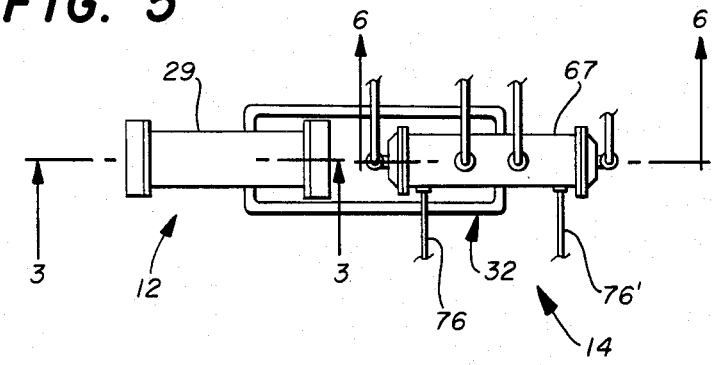
FIG. 5 is an enlarged, side elevational view of part of the apparatus disclosed in some of the foregoing figures.
Figure 9:
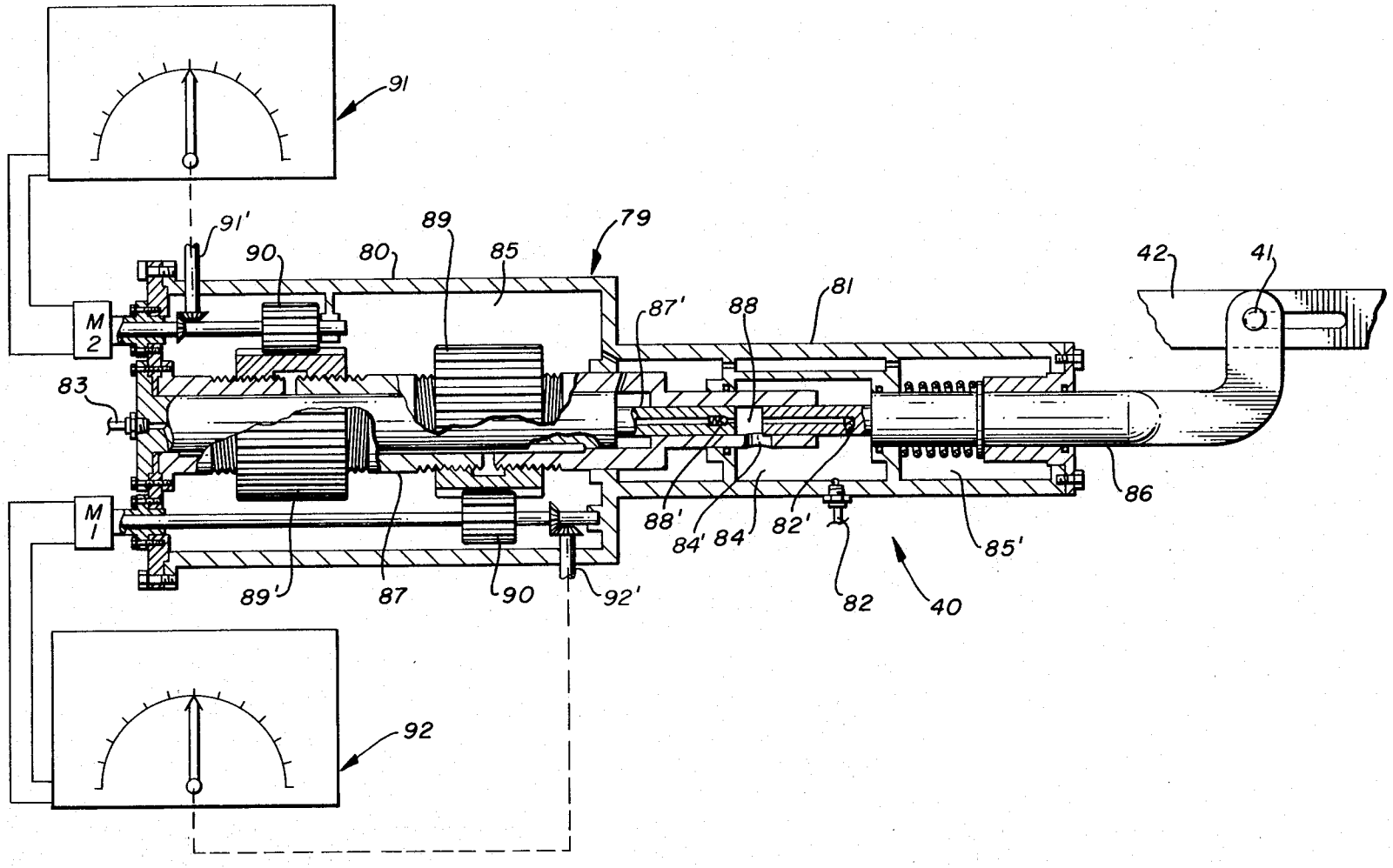
FIG. 9 is an enlarged, part cross-sectional, fragmentary view which sets forth the details of part of the apparatus disclosed in FIG. 2; with some parts thereof being broken away therefrom in order to better illustrate the apparatus.

In FIG. 4, sequence switches 39 and 39' are electrically connected to energize the solenoid actuators 62 and 62'. Injector pump 40 of FIGS. 3 and 9 is actuated by pin 41 (FIG. 3) which in turn is moved by the lost motion slot formed in lever 43 of hydraulic cylinder 36. Lever 43 is actuated by pin 44.

In FIG. 3, exhaust valves 45 and 45' are seen to be connected for exhausting spent combustion gases from the combustion cylinder. The valves are actuated by levers 46 and 46', which in turn are actuated by over-the-center mechanism 47. The over-the-center mechanism is in the form of a spring loaded toggle having a free end 48 operatively associated with a spring loaded ratchet member 49 formed at each marginal end of the lower control rod 35. The toggle and the ratchet member cooperate together to move the valve 45 to the open position when the ratchet is moved by the yoke towards the medial part of the internal combustion cylinder and vice versa.

Support 50 of FIG. 3 locates bearings 51 and 51' in fixed relationship respective to the combustion cylinder, and provides low friction support means by which the lower control rod 35 can be reciprocated by the yoke 32.

Ignition plug 52 is provided in each cylinder head. An intake valve 53 connects the interior of each cylinder head to the air reservoir 18. Intake valve lever 54 is indirectly connected to the piston of hydraulic cylinder 36. An axially rotatable rod 55 is connected to cam 56 for moving lever 46 of valve 45 to a closed position in response to movement of the piston associated with cylinder 36.

In FIG. 4, the spaced star wheels 57 and 57' are rotatably mounted in fixed relationship respective to the internal combustion engine cylinder. A plurality of circumferentially extending radial pins 58 are arranged to be engaged by the end of shaft 43, and also by the illustrated spring loaded cam. The star wheel 57' is moved in a counter-clockwise direction when cylinder 36 extends control rod 43, and also when pin 33 moves control rod 34 in a right hand direction. Spring loaded plunger assembly 59 engages the illustrated circumferentially extending detents of the star wheel. The spring loaded plunger is forced to reciprocate when star wheel 57 is forcibly rotated by either of control rod 34, the spring loaded cam, or by control rod 43 as a longitudinal force is applied to a pin 58. There are twice as many detents as there are pins circumferentially placed in spaced realtionship about the wheel. The sequential operation of the control rods is such that rod 34 will first move star wheel 57 one detent position in a counter-clockwise direction, followed by control rod 43 at the appropriate time which will also move star wheel 57 one detent position. Spring loaded plunger 59 will meanwhile maintain the proper relative position of the star wheel 57 following the action of the control rods. Ignition points 39 make contact following the action of control rod 34, causing the points to break contact following the action of control rod 43.

Time delay 61 is connected to be actuated by the secondary solenoid 62. The secondary solenoid overlies a primary solenoid which is connected in series to points 39. The illustrated contacts 63 are normally open and are moved to the closed position upon movement of the armature of the primary solenoid 62. Closing of the points 63 energizes the secondary solenoid 62. Points 64 are mounted to be opened by the illustrated cam located on yoke 32. Pressure actuated switches 27 and 28 control the actuation of the before mentioned electrically powered hydraulic pump and activates or deactivates the engines electrical system.

FIGS. 5–8 of the drawings illustrate the details of one preferred form of the hydraulic pump 14. The hydraulic pump includes a main housing 67 which forms an interior 68 in the form of a counterbore formed axially therethrough. Slots 69 formed in a medial part of the housing accommodates the reciprocating yoke 32 which extends through the slotted wall. The counterbore forms working chambers 70 and 70' which are isolated from one another by the medial part 68 of the housing. A connecting rod 71 has a medial portion thereof affixed to the yoke 32. Opposed bifold piston assemblies 77 are hinged to the rod ends and each include means by which they are spring loaded apart. The working cylinders include opposed diverging cylinder walls 73 which diverge toward the bifold piston assemblies and converge toward the check valve assembly 75.

Suction check valves 74 and 74' are connected to the hydraulic fluid reservoir and provide a source of spent power fluid behind or downstream of the piston assembly. High pressure check valves 75 are located in each of the opposed ends of the housing and fluid flow thereacross proceeds to the accumulator. A flow conduit 76 is connected to the valve assembly 23 in the illustrated manner of FIG. 2, and conducts power fluid from the accumulator to a location between the bifold doors and the valve 75 so that power fluid from valve assembly 23 can stroke the pump and engine.

The doors 77 each include the illustrated free end portion which sealingly engages the wall surface 70 and 73 of the working chamber, and further includes a hinged end at 78 which sealingly mounts the doors to the connecting rod. As best seen illustrated in FIG. 8, the doors have sealed edge portions which isolate the working chamber from the suction chamber.

In FIG. 9 of the drawings, there is disclosed the before mentioned injector pump 40. In the preferred embodiment of FIG. 9, the illustrated pump is seen to include a housing 79 which forms a large outside diameter portion 80, and further includes a small outside diameter portion 81 connected thereto. Fuel inlet 82 conducts fuel flow from the fuel tank into the chamber 84 formed within the small diameter portion of the housing. A one-way check valve 82' admits fuel into the illustrated plunger. High pressure fuel outlet 83 is connected to the engine combustion chamber. Fuel inlet cavity 84 is always filled with suitable combustion fluid, for example diesel fuel. A common cavity 85 is connected to chamber 85' by means of the illustrated ports. A spring loaded pump shaft 86 is actuated by the before mentioned pin 41 whenever control rod 42 is moved in response to actuation of the piston by cylinder 36.

A longitudinally extending adjusting shaft 87' is rigidly affixed to housing 79 and is provided with the illustrated axial passageway which interconnects check valve 88' with the before mentioned outlet 83. Couplings 89 and 89', respectively, are right handed and left handed threaded surfaces which threadedly engage the illustrated marginal sleeve sections. Drive gears 90 and 90' mesh with and drivingly engage the geared surface located externally of the sleeve sections. The sleeve sections form coupling members which adjust the displacement at 88 between the end of shaft 87' and port 84'. The range or relative distance between the end of plunger 86 and shaft 87' remains fixed. Accordingly, it is the relationship between the end of shaft 87' and port 84' which determines the quantity of fuel injected each stroke of the plunger 86.

Pressure responsive control means 91 controls the operation of gear coupling 89', while temperature responsive control means 92 control the action of the motor connected to the gear coupling 90. The illustrated control rods are connected to move and reset the controls as illustrated in the drawings so that the quantity of fuel delivered at 93 is accurately metered at 88 to compensate for changes in ambient conditions.

Figure 10:
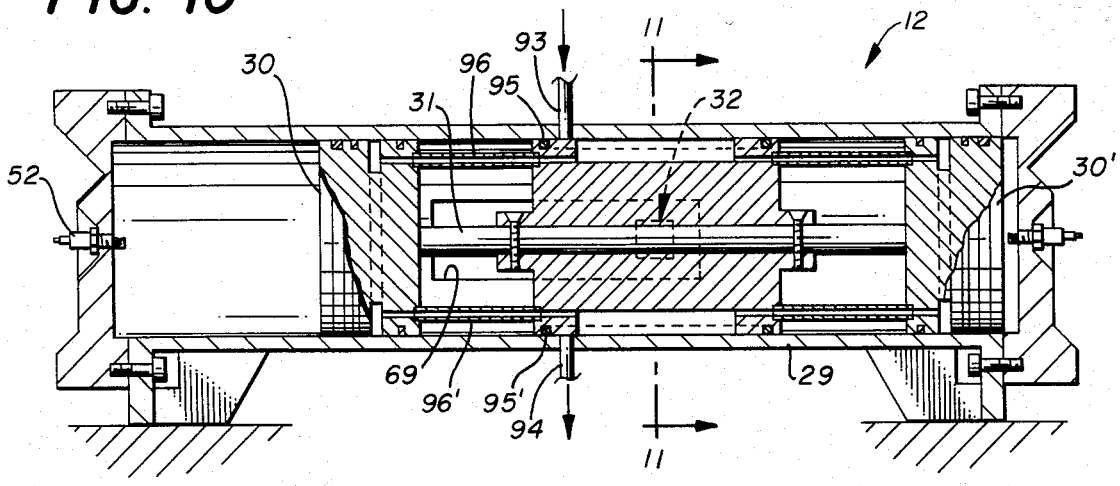
FIG. 10 is an enlarged, part cross-sectional, detailed view which discloses additional details of FIG. 3.
Figure 11:
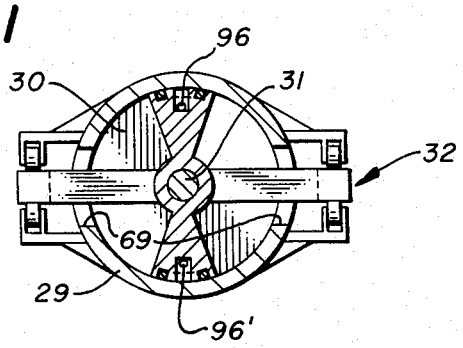
FIG. 11 is a cross-sectional view taken along line 11—11 of FIG. 10.

In FIGS. 10 and 11, there is set forth an oiling system for the internal combustion engine 12. An oil inlet 93 and an oil outlet 94 are connected to a medial portion of the cylindrical motor housing. Seals 95 and 95' are formed within block 96 and are reciprocatingly moved therewith. The block is reciprocated by the piston and is arranged to cover the high pressure oil inlet 93 towards the end of the stroke. Seals 95 seal the traveling block respective to a cylinder wall and form an inlet chamber through which lubricating and cooling oil can flow into the tubing 96, into the piston thereby lubricating the piston wall, and back through the outlet 96', into the lower block, into the block chamber, into outlet 94, and back to the reservoir.

In FIGS. 12–18, there is disclosed one embodiment of a hydraulic motor 15 made in accordance with this invention. The motor includes a housing 97 from which there extends a power output shaft 98. A control cylinder actuator 99 includes a pressure actuated piston therewithin which extends into engagement with a cross-arm 100 in order to reciprocate the spaced apart control rods 101.

Figure 13:
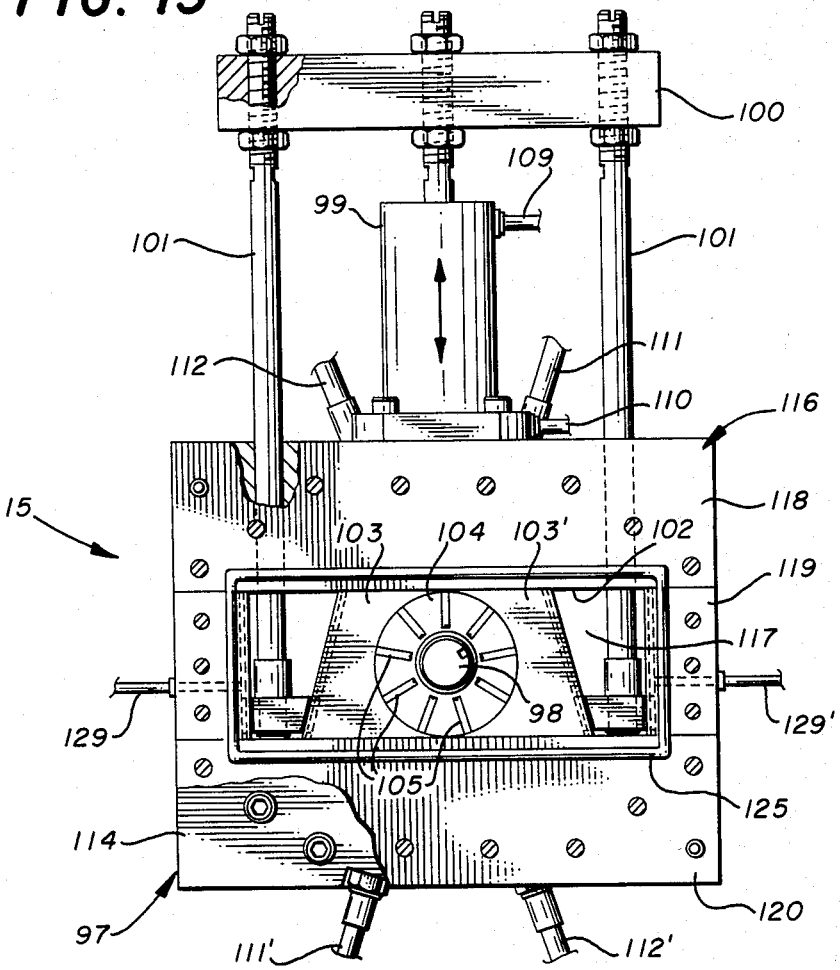
FIG. 13 is a front elevational view of the apparatus disclosed in FIG. 12; with some parts being removed therefrom, and other parts being broken away in order to disclose additional details thereof.
Figure 14:
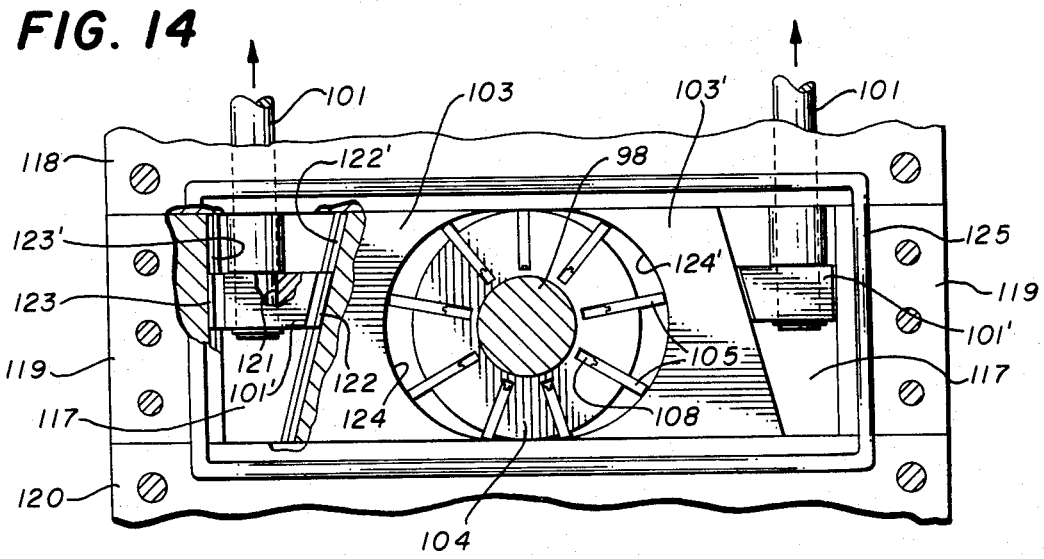
FIG. 14 is an enlarged, fragmentary view of part of the apparatus disclosed in FIGS. 12 and 13.
Figure 15:
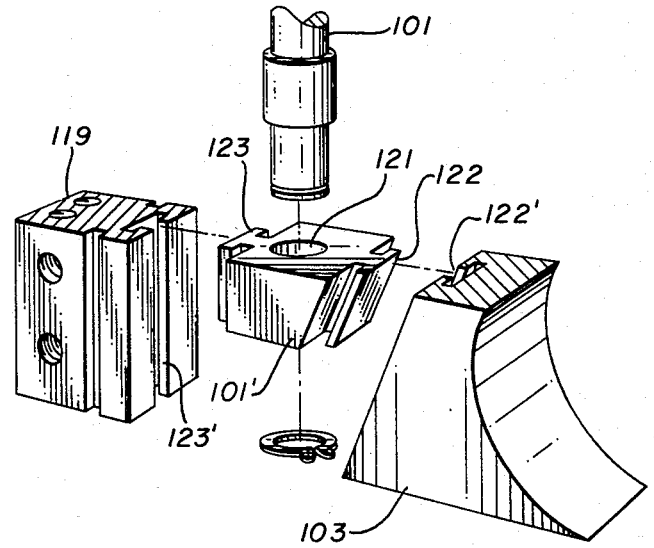
FIG. 15 is an enlarged, exploded view of part of the apparatus disclosed in FIGS. 12–14.
Figure 16:
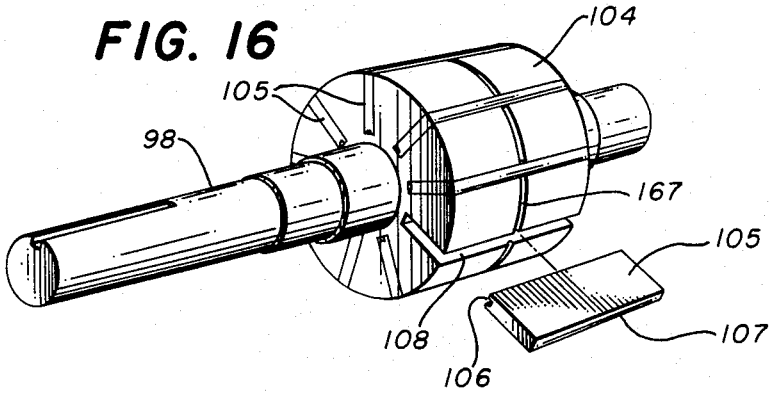
FIG. 16 is an enlarged, perspective view of part of the apparatus disclosed in FIGS. 12–14.

As particularly seen illustrated in FIG. 13, together with other figures of the drawings, numeral 102 indicates a wall surface which forms a rectangular cavity within the housing. A pair of opposed stators 103 and 103' are spaced from one another and are arranged to reciprocate in a horizontal plane and move towards and away from one another by means of vertical reciprocatory movement of control rods 101. Rotor 104 is connected to a shaft 98 and is supported within the housing by suitable low friction bearing means. A plurality of vanes 105 are received within the illustrated radial slots of the rotor. FIGS. 14 and 16 particularly illustrate the details of the radial slots.

Figure 12:
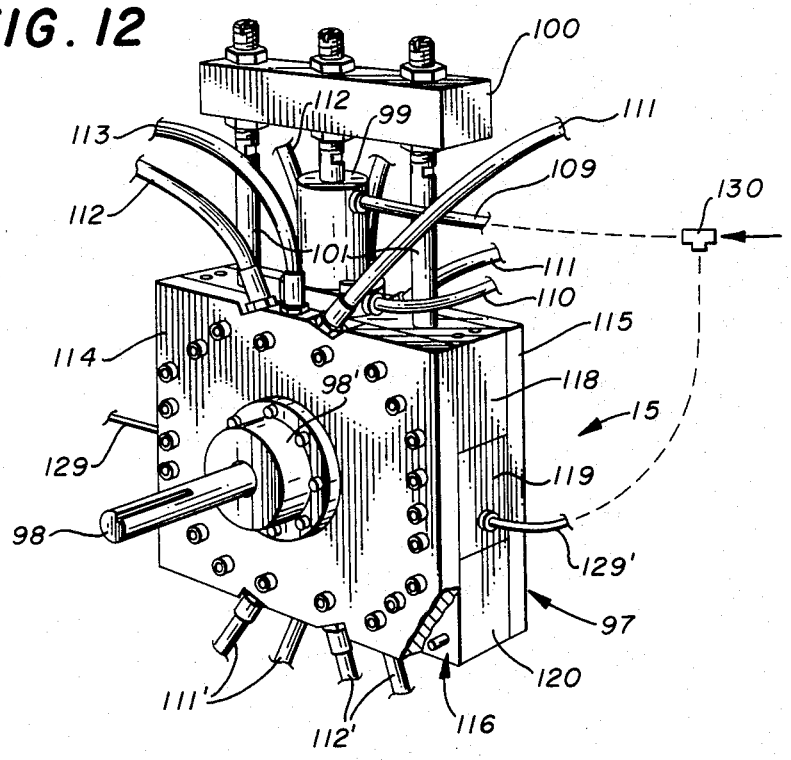
FIG. 12 is a perspective view of one embodiment of the hydraulic motor disclosed in FIG. 1, for example.

As best seen illustrated in FIG. 12, hydraulic flow lines 109 and 110 are connected to control the position of the piston located within the actuator 99. The hydraulic flow lines 111 and 111' are connected to the accumulator 16 through valve 24 which is connected to determine the direction of rotation of the motor. Lines 112 and 112' are connected to conduct flow to and from the reservoir. The recited connections result in clockwise rotation of the motor. Counter-clockwise rotation requires the reverse of the indicated connections. Line 113 is always connected to the accumulator to provide a constant source of hydraulic pressure under the vane and thereby maintain proper contact with the stators.

The motor includes a removable front plate member 114 which is identical to a removable rear plate member 115. A front face 116 isolates chamber 117 within which a control 124 is reciprocated by a control arm 101.

FIG. 14 illustrates that the main housing includes an upper member 118, two spaced central members 119, and a lower member 120. The block 101' is apertured at 121 for receiving the lower marginal end of the control rod 101. As seen illustrated in FIGS. 14 and 15, the block is removably affixed to the rod end and includes the T-shaped member 122 which is received with the female T-shaped member 122' of the stator. The T-shaped male member 123 is received within T-shaped slot 123' of housing member 119.

Figure 17:
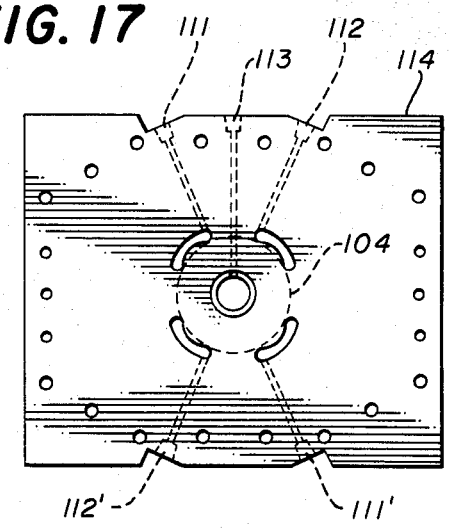
FIG. 17 is a front elevational view of part of the apparatus disclosed in FIG. 12.
Figure 18:
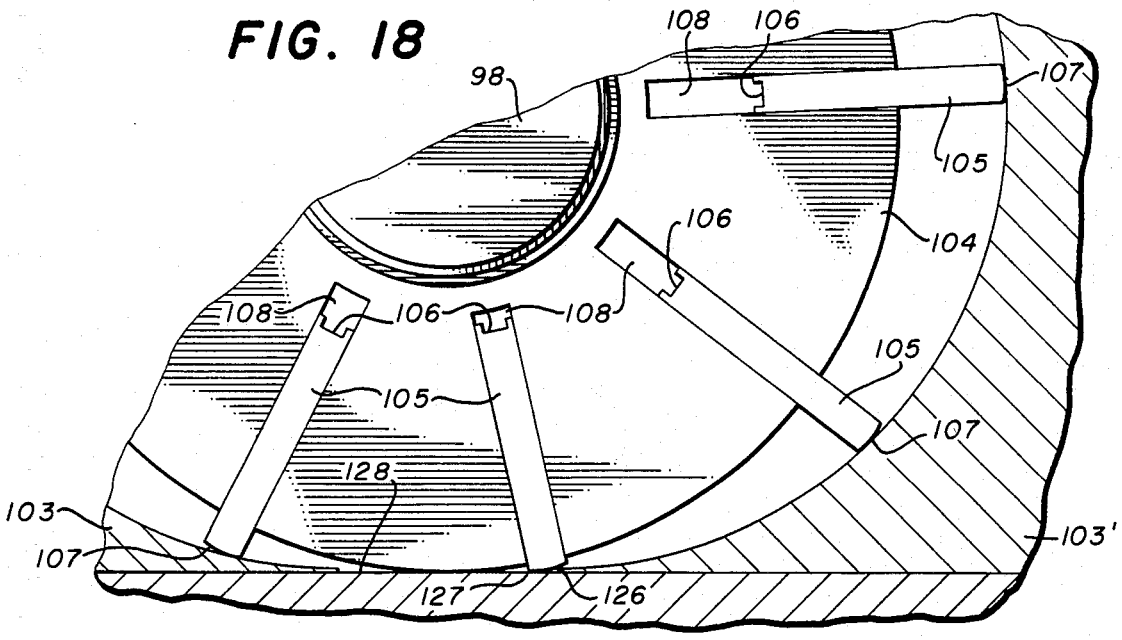
FIG. 18 is an enlarged, broken, detailed view of part of FIG. 14.

FIGS. 16–18 illustrate that the stator is provided with a circular face 124 of the same diameter as the o.d. of the rotor. An o-ring seal 125 extends about the entire opening of the housing, as illustrated in FIG. 14.

In FIG. 18, numeral 126 indicates the leading edge or toe of one of the stators 103'. The outermost end portion of the vanes 105 is contoured identical to the contour of stator 103', which is also the same radius of the rotor. As the end 127 of vane 105 approaches the toe 126 of the stator, part of the end 107 contacts and rides on floor 128 while another part of the vane 105 contacts and rides on the toe 126, thereby providing a smooth transition as the outer end of the vane is rotated from floor 128 onto the cylindrical wall surface 124 or stator 103'.

Numerals 129 and 129' are pressure or bleed lines. Numeral 130 is a tee which connects together the two lines. Hub 131 supports a seal and bearing therewithin.

Figure 19:
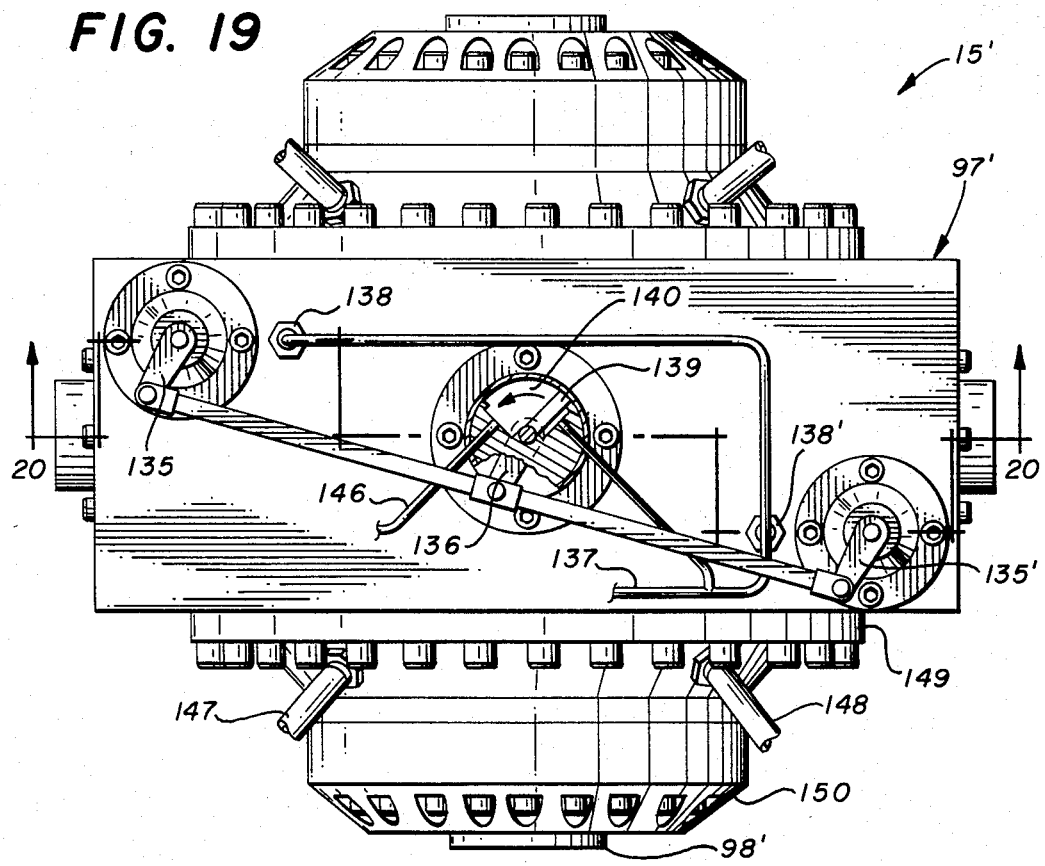
FIG. 19 is a top plan view of a second embodiment of a hydraulic motor made in accordance with the present invention.
Figure 20:
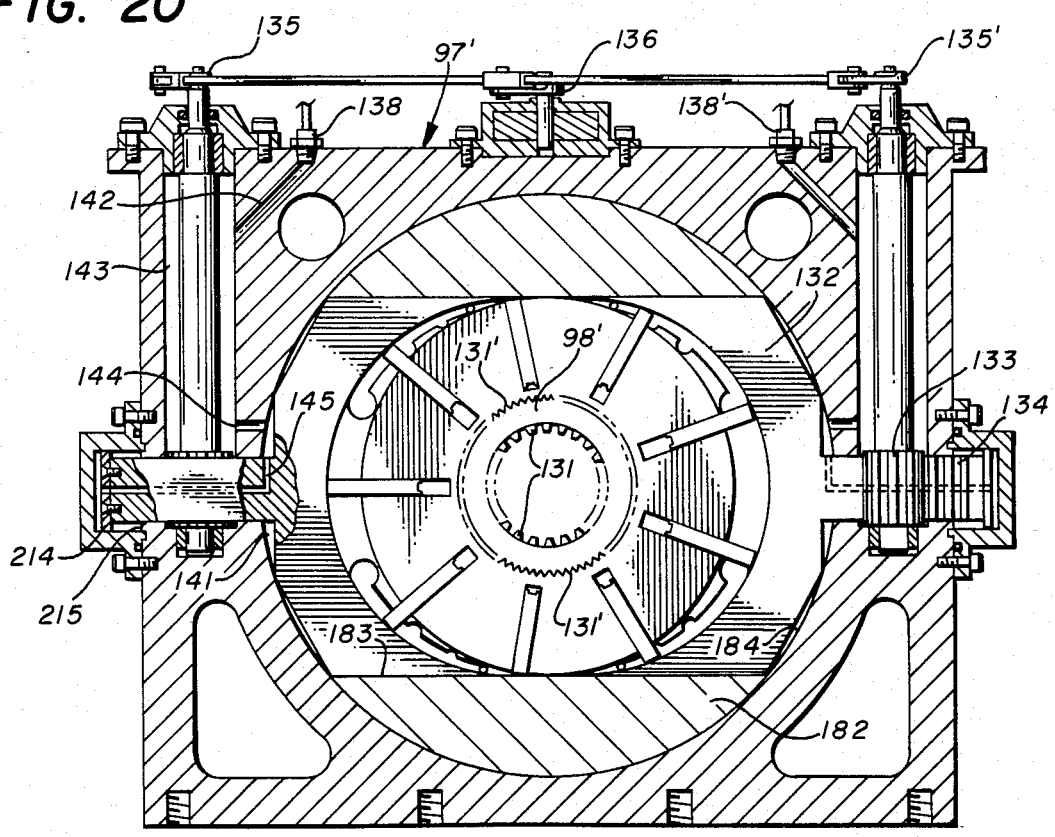
FIG. 20 is a cross-sectional view taken along line 20—20 of FIG. 19.

Another embodiment 15' of the hydraulic motor is set forth in FIGS. 19–20. This embodiment of the invention includes opposed power output shaft end 98' having external and internal splines, 131 and 131'. Spline 131' engages the rotor while internal spline 131 provides a means by which the motor is conveniently connected to a load. Stator 132 is moved toward and away from the rotor by the illustrated rack and pinion 133 and 134. Crank 135 is connected to move the rack and pinion in accordance with the position of actuator 136.

Ports 138 and 138' are connected to the supply line 137 leading to the illustrated actuator. As seen in FIGS. 19 and 20, the actuator includes a vane 139 and variable chamber 140. Accordingly, the vane 139 is moved in accordance with the pressure effected thereacross.

In FIG. 20, a pressure differential chamber 141 is connected to the before mentioned port 138 by means of passageway 142, annular passageway 143 formed about the pinion shaft, and a port 144. A drilled passageway 145 interconnects the chamber 141 with the rear face of the rack to thereby provide a pressure differential thereacross which assists moving the stator toward and away from the rotor. Return line 146 is connected to one side of the vane 139, while pressure line 137 is connected to the opposed face, thereby driving the vanes in the direction of the arrow, which in turn causes actuator 136 to move the pinion shaft, which in turn drives the stator towards and away from the rotor. Stop member 214, seen in FIG. 20, and shoulder 215 prevents the rack from causing the opposed stators to be moved against the roller with excessive force.

Figure 21:
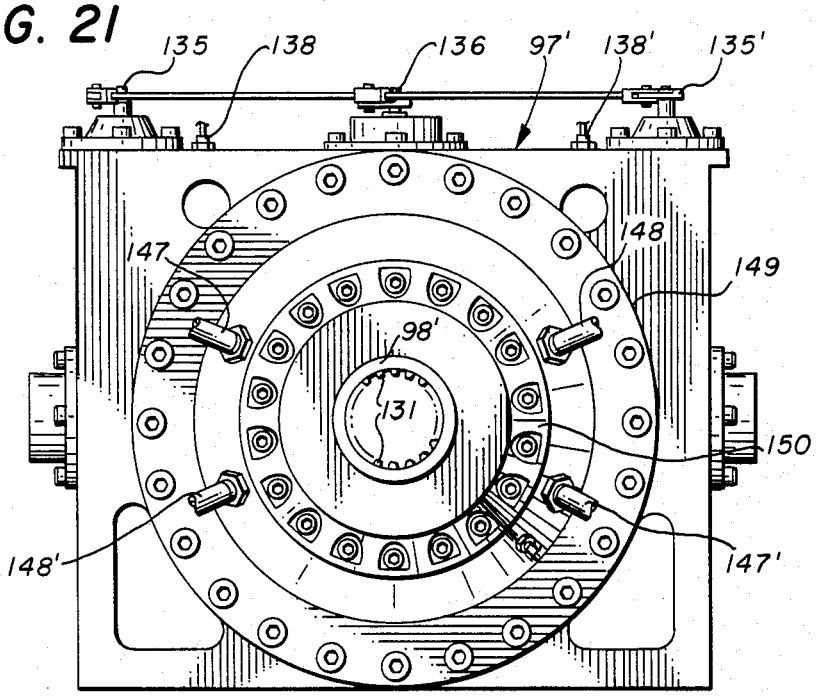
FIG. 21 is an end view of the motor disclosed in FIG. 19.

In FIG. 21, together with other figures of the drawings, a power fluid inlet 147 and 147'; and, spent power fluid outlet 148 and 148' are formed within the end plate 149. A shaft seal plate 150 is received about the power output shaft.

Figure 22:
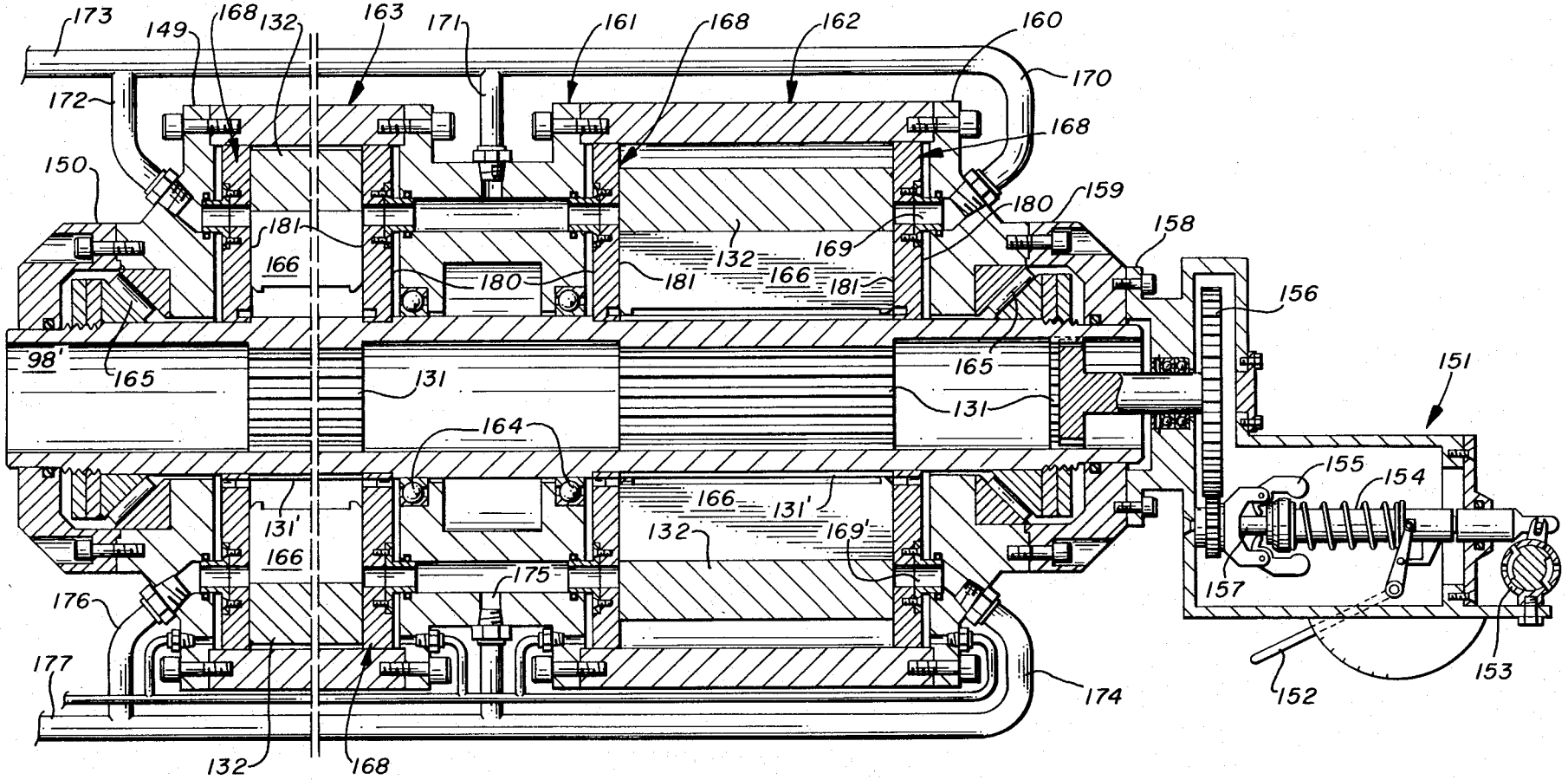
FIG. 22 is a broken, longitudinal, cross-sectional view of the motor disclosed in FIG. 21.

In FIG. 22, a governor 151 is connected to maintain a constant rotational speed of the rotor, in accordance with the setting of throttle 152. Valve 153 is operated by a sleeve 154 and supplies power oil to the actuator 136. With the motor operating at the speed indicated by speed control lever 152, valve 153 is positioned in a neutral position, and should the speed increase or decrease, the sleeve 154 will be moved by either the spring pressure or the pressure generated by the governor weight, which causes the valve 153 to send power oil to the actuated in the appropriate direction to cause the stators to move either in or out, as may be required for regulating the speed of the motor. As speed is regulated, the valve will seek the neutral or set position. The flow of power oil for propelling the motor does not go through the valve 153.

The governor end housing 158 is attachable to either end of the pump of FIG. 19. A bearing housing 159 provides a mounting means for the bearing and shaft seal. End plate 160 is identical to the opposed end plate 149.

In the embodiment of the motor disclosed in FIG. 22, there are 2 identical motors, such as seen illustrated in FIG. 19, connected together by means of adapter connector 161. Numeral 162 indicates a first motor while numeral 163 indicates a second motor. Bearings 164 are suitably mounted within the adapter connecter, while tapered bearings 165 are employed at the opposed ends of the shaft.

Rotor 166 has an axial passageway formed therethrough which is splined to cooperate with the before mentioned splines 131. The rotor includes a groove 167 for a purpose which will be more fully discussed later on.

Pressure plates 168 bear simultaneously against the end faces of the stator and the end of the rotor. The pressure plates include slip joints 169 which facilitate connection to flow lines 170, 171, 172, 173, 174, 175, 176, and 177; and which also allow the pressure plates to move axially in or out as required to maintain proper contact.

Figure 23:
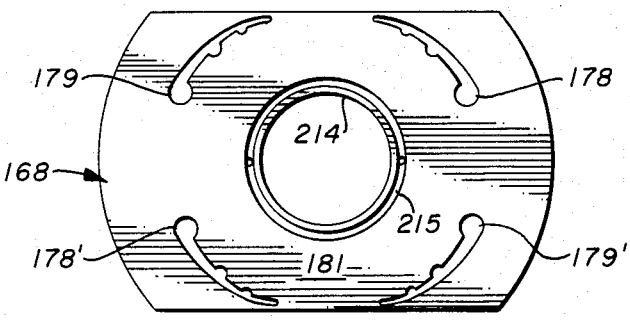
FIGS. 23 and 24 are elevational views which set forth the details of some parts associated with the motor of FIG. 21.
Figure 25:
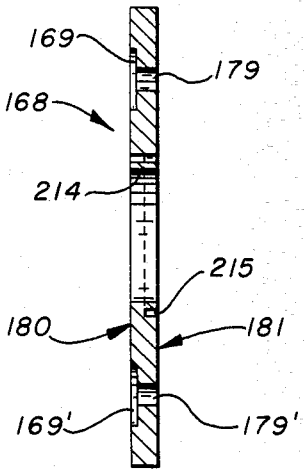
FIG. 25 is a cross-sectional view taken along line 25—25 of FIG. 24.
Figure 24:
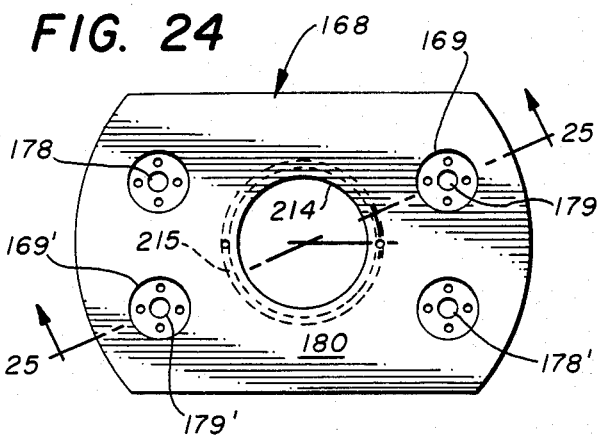

As best seen in FIG. 23, together with other figures of the drawings, plate 168 is apertured to provide a crescent shaped fluid flow passageway for providing throttling of the power fluid as the stators are moved towards and away from one another. Numeral 179 indicates the return crescent shaped throttling aperture formed within face 181 of the plate.

As seen in FIG. 20, a crescent housing port 182 provides a convenient means for the provision of a floor 183. Circulator wall 184 cooperates with floor 183 and the opposed roof to provide a working chamber for the opposed stators.

Figure 26:
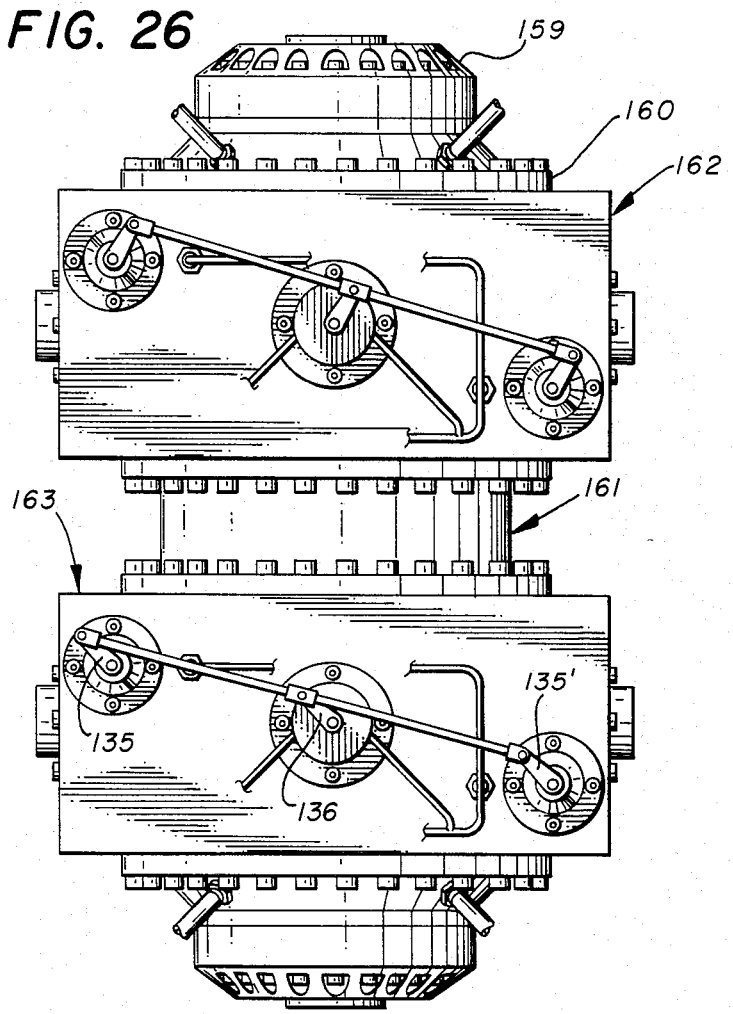
FIG. 26 is a top plan view of another embodiment of the hydraulic motor disclosed in FIG. 21; and, FIG. 27 is a schematical representation of a fluid flow circuit to actuate the hydraulic control for the motor of FIG. 26.
Figure 27:
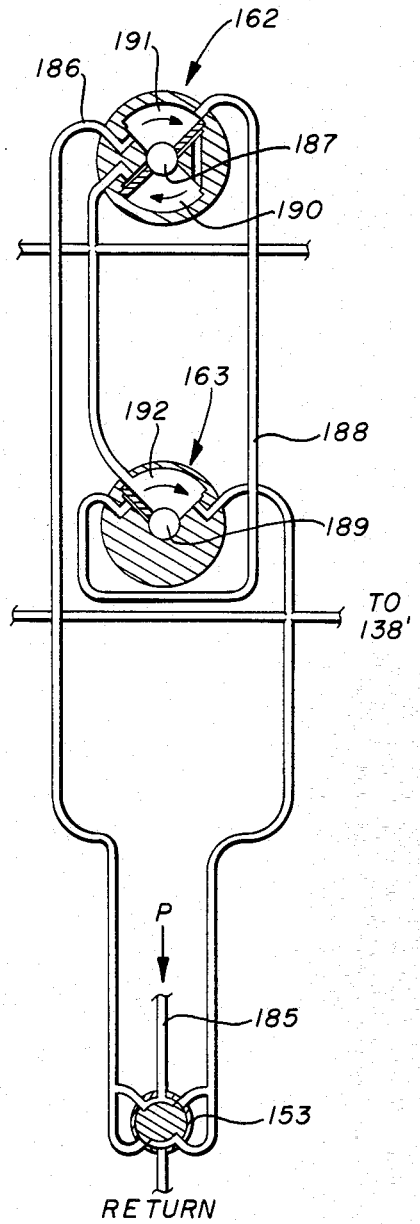

In FIGS. 26 and 27, flow line 185 is connected to a source of power fluid for providing flow through the line 186 and into the variable chamber 191 of the controller for the first motor 162, thereby moving the illustrated actuator shaft 187 toward the wide-open position, so that all of the power fluid first flows to the first motor 162 before flowing into the second motor. Flow line 188 conducts power fluid into the variable chamber 192 of the second motor controller actuator after shaft 187 has been fully moved to the open position, whereupon shaft 189 is rotated in the direction indicated by the arrow. Chambers 190, 191, and 192 are variable chambers which accommodate the illustrated vanes. The vanes are forced to open to the closed position in accordance with the position of valve 153.

Looking again now to the details of the air compressor of FIG. 2, wherein there is disclosed a pump housing 193 which includes a vane-type piston 194 pivotally received in an oscillatory manner therewithin. A discharge line 195 connects the air storage tank 18 with the variable chamber of the compressor. The lower edge of the piston is pivotally mounted at 196 and is slidably sealed in low friction relationship at each edge portion thereof. A check valve 197 permits flow of air into the variable chamber but precludes reverse flow of air back through the piston. The arcuate cylinder wall 198 cooperates with the adjacent side walls to sealingly engage the edge portions of the piston. The piston face 199 confronts the end wall 200 of the variable compression chamber.

Pin 201 is slidably received in captured relationship within track 202, and attaches a guide bar 203 to the piston. The opposed edges of the guide bar are slidably received within the spaced apart guide rollers 204. The guide bar prevents deflection and therefore rigidifies the structure as the rollers bear against the hydraulically actuated cylinder 205. The cylinder 205 has a lower terminal end pivotally mounted at 206 to suitable support structure, such as the main frame.

Pin 207 is connected to reciprocate with the cylinder, and is positioned to actuate a toggle assembly 208, which in turn is connected to position valve 209 in a manner to cause power fluid and spent power fluid to alternately flow to and from the cylinder by means of the flow lines 210 and 212. Pin 213 also is connected to move with the cylinder and is positioned to reset the toggle as the assembly moves in a downward direction.

In the fuel injector 40 of FIG. 9, the sleeve 87 is slidably received over the fixed shaft 87', and is made in three separate pieces. The first piece, shown on the left side, is rigidly secured to case 80 on the left end. The right end of the sleeve has right hand threads. The center section of the sleeve is provided with left hand threads on the left end and right hand threads on the right end. The right hand section is provided with left hand threads on the left side, and the right hand side is constructed so that it is free to slide back and forth within housings 80 and 81, thereby moving axially respective to the housing and shaft 87'. The extreme right hand portion of the sleeve is machined internally to slidably receive the end portion of the plunger 86 in close tolerance relationship therewith. Relative rotation of this three section sleeve is prevented by providing a square key which extends into all three pieces and jointly engages the shaft 87' and the sleeve. The three pieces are connected together by internally threaded gears 89 and 89'.

The internal threads of each gear provides right hand threads on the left end and left hand threads on the right end. As gears 89 and 89' are rotated in one direction, the three part sleeve is shortened, and when the gears are rotated in the opposite direction, the sleeve becomes longer. Each gear can be rotated independently of the other. Gear 89' is rotated by drive gear 90', and gear 89 is rotated by drive gear 90. The drive gears are in constant mesh with the driven gears and are disposed in a fixed position longitudinally respective to the case 80. Rotation of the driven gears 89 and 89' axially moves the relative position of the gears 89 and 90 respective to the shaft 87'. For this reason, the driven gears are twice the length of the driving gears, thereby enabling the driving gears to slide longitudinally along the teeth of the driven gear while maintaining constant mesh therewith.

Pumping of fuel is achieved by the reciprocating motion of plunger 86, which is always the same stroke or distance. The right hand portion of the three part sleeve, being machined to receive the marginal end portion of plunger 86, becomes a pumping chamber 88 containing the fluid to be pumped. A hole 84' is formed in spaced relationship relative to the end of shaft 87' and at a location which determines the amount of fluid pumped each stroke of the plunger.

Should the edge of this hole be aligned with the end of shaft 87', as the plunger 86 moves toward shaft 87', no fluid will be pumped through passageway 83, but instead the fuel will escape from the chamber 88, through the hole 84'. As the hole 84' is moved away from the end of shaft 87', the plunger will seal off this hole as it moves through chamber 88, whereupon fuel is forced through check valve 88', and into the drilled passageway 83 of shaft 87', and into the injector of one of the combustion cylinders. As the plunger is withdrawn from the pumping chamber 88, it will tend to create a vacuum, making withdrawal difficult. To overcome this condition a check valve 82' is provided in the plunger which allows fluid from reservoir 84 to enter the pumping chamber 88 through the drilled passageway, thereby eliminating the possibility of creating a vacuum, and enhancing fuel flow.

The position of the hole 84' in relation to the end of shaft 87 is determined by the position of the two threaded gears 89 and 89'. Drive gears 90 and 90' are each driven by separate electric motors M1 and M2. The direction of rotation of each motor is automatically controlled by the control devices 91 and 92. One device 91 is actuated by the temperature of the air in the air tank, and the other device 92 by the pressure of the air in the tank.

The control devices each actuate a shaft 91' and 92' which extends outward from and is rotated by a set of bevel gears to provide a right angle drive to the shaft connecting the appropriate electric drive motor to one of the pinions 90 or 90'.

OPERATION

In FIG. 2, the 2,000 psi oil accumulator 16 provides power fluid for a variety of functions, as will be more fully discussed later on herein. One of these functions is the provision of a control center for the entire system. It has been ascertained that greater fuel efficiency is achieved when all hydraulic components perform their intended functions at oil pressures which is consistent with the generated pressure, which is 1900 to 2000 psi, for example. This type of operation avoids heat build-up due to pressure reductions or restrictions and corresponds to the structural integrity of the seals, hoses, and the like. The accumulator provides the flexibility of producing energy in varying quantities, accumulating and storing this energy at a relatively constant level, and disbursing this stored energy at a rate consistant with demand, and not to the rate at which it was generated. Volume or quantity of oil produced and utilized is automatically regulated by controlling the appropriate pressures throughout the system.

The accumulator provides an instantaneous source of energy, and as disbursement of the power fluid thereof lowers this capacity; it will, in conjunction with various components of the system as indicated below, activate the components necessary to supplement and replenish this supply source only in the quantity required, and only when required, with there being no excess power oil produced beyond the requirements of the accumulator.

As the accumulator 16 pressure falls below 1900 pounds, for example, the pressure control switch 28 opens and deactivates the electrical system which controls the combustion process. Control switch 28 has dual contacts wherein a pressure valve below 1900 pounds or above 2000 pounds opens the contacts. A pressure between 1900 pounds and 2000 pounds will close the contacts and activate the electrical system. The contact points in the pressure control switch 27 are closed when the accumulator 16 pressure falls to 1850 pounds or less, and are opened at 1950 pounds. Closing of these electrical contacts activates an electric motor driven hydraulic pump 26 which is powered by a storage battery, or other convenient means of stored energy. Pump 26 draws oil from the system reservoir 17 to pressurize the accumulator 16 to the above recited pressure level. As the accumulator pressure begins to rise, air compressor 21 of FIG. 2 becomes operational.

The air compressor 21 has a hydraulically actuated cylinder 205 directly connected by means of valve 209 and hydraulic flow lines 210 and 212 to the accumulator and oil reservoir. The valve 209 is actuated by the toggle apparatus 208 to appropriately direct the hydraulic fluid to impart reciprocatory motion of the piston within the hydraulically actuated cylinder 205. The geometry resulting from pivot point 206, rollers 204, roller 201 and the guide 202, causes the piston to move rapidly and thereafter move slowly during the compression stroke, thereby providing the apparatus with increasing moments or mechanical advantage as the piston nears the confronting face 200 of the compression chamber. This action coupled with a large piston rod of the hydraulic cylinder provides fast piston movement in the unloaded condition. The geometry of the mechanism connecting the actuator rod of cylinder 205 to the piston 194 is such that 1900 psi of hydraulic pressure maintained in the chamber of cylinder 205 will result in a maximum air pressure of 150 psi being produced and maintained by piston 194 of air compressor 21, regardless of the position of the piston 194, when this pressure is attained. The balance of power exerted by the 1900 psi hydraulic pressure in the cylinder versus the opposing force of 150 psi air pressure is such that a slight decrease in air pressure will automatically allow the hydraulic pressure to compensate, thereby evenly maintaining the 150 psi air pressure with no valves or switches being required beyond the disclosed apparatus. As the air pressure reaches the desired operating pressure of 150 psi, the entire mechanism is stopped, and no further piston motion occurs until the pressure drops below this value. In order to more precisely and evenly control the 150 psi pressure in the air reservoir, a pressure regulator valve (not shown) is used in line 210, so that no pressure in excess of 1900 psi is permitted to enter the hydraulic cylinder 205.

As the electric driven hydraulic pump raises the accumulator pressure to the desired operating range of 1900 psi, the air compressor will have charged the air storage reservoir to its required 150 psi, and the electric contacts in the control switch 28 will close, thereby energizing the electrical system. The electric driven hydraulic pump will continue to operate until a pressure of 1950 psi has been reached in the accumulator.

As shown in FIG. 3, piston 30' is in position to receive a combustible mixture. In this position, the star wheel 57' of FIG. 4 is positioned as shown with contact points 39' in the closed position. The control switch 28 is in the closed position and current can now flow through solenoid 37, on through the primary coil of solenoid 62, and to the ground through contact points 39'. Two things happen when solenoid 37 closes. As the armature of the solenoid moves down it closes the illustrated set of contact points mounted on the solenoid. These points are connected directly to the battery, therefore if for some reason the control switch 28 opens during this cycle this alternate source of electric energy permits this one cycle to be completed independent of control switch 28.

Moreover, since solenoid 37' was activated, the armature of the solenoid pulled the operating arm of valve 60' down, opening the passageway and allowing oil from the accumulator to enter the control cylinder 36'. Simultaneous to the operation of solenoid 37', the series connected primary coil of solenoid 62' is activated which caused contact points 63' to close. The secondary coil of solenoid 62' has a direct source of energy from the battery and therefore, the closing of the contact points 63' enables current to flow from the battery, through the secondary coil, through points 63', and to contact points 64', which in this position will be closed due to the position of the cam located on power yoke 32, thereby providing a ground terminal and allowing the circuit to be completed. Activation of the secondary coil of solenoid 62' starts in the operation of the time delay switch 61', the operation of which will be more fully discussed later on.

As oil enters control cylinder 36', rod 42' begins its outward movement which rotates rod 55', thereby rotating cam 56' which pushes toggle assembly 47' to the left with an over center rapid action, which moves exhaust valve 45' to the closed position. Further extension of control rod 42' causes the cam located on top of the rod to close contact points 38', thereby energizing high tension coil 37'. During this extension the control rod 42' also moves the control arm 54' of air inlet valve 53'. Simultaneous with the opening of inlet valve 53' injector pump 40' is activated and fuel is injected into the air stream flowing into the combustion chamber. During this forward movement of the control rod 42', pin 44' attached to rod 42' reaches the end of the elongated hole formed in plate 43' and moves this plate forward into contact with the appropriate pin 58' mounted on star wheel 57'. This action rotates the star wheel 57' one detent position, allowing points 39' to open. With the opening of points 39' the electric circuit through solenoid 37' is broken, thereby de-energizing the coil and allowing the spring to return valve 60' to the closed position, whereupon the oil used in extending control rod 42' of control cylinder 36' has an open passageway formed back to the system reservoir.

It should be evident that the control cylinder 36' is forced into the outward position by oil pressure from the accumulator and the piston is spring returned which expels the spent oil back to the reservoir. During the return of the piston, the cam located on top of control rod 42' that closed contact points 38' on its forward stroke will now permit the points to open. As the points 38' open, the field built up in high tension coil 37' will collapse causing a spark to occur across the spark plug 52', thereby igniting the fuel-air mixture contained within the combustion chamber.

The aforementioned secondary coil of solenoid 62' is activated when contact points 63' and 64' are closed, to activate time delay switch 61'. After combustion occurs, the resulting movement or power stroke of the piston moves power yoke 32', thereby allowing points 64' to open, thus de-energizing the secondary coil of solenoid 62', and thereby de-activating the time control. Should piston movement fail to occur as a result of combustion failure, time delay 61' will continue to be operational, and after its programmed time period of approximately ½ second has elapsed, it will be activated. The time delay is directly connected to the battery and upon activation, current flows to the appropriate solenoid in mechanism 23. Two solenoids are used in mechanism 23, both being connected to the operating lever of the valve in this mechanism; however, the connecting linkage is such that either solenoid can move the valve in its intended direction without effecting the other. The hydraulic valve of this mechanism has a direct connection to the accumulator and the system reservoir.

Figure 6:
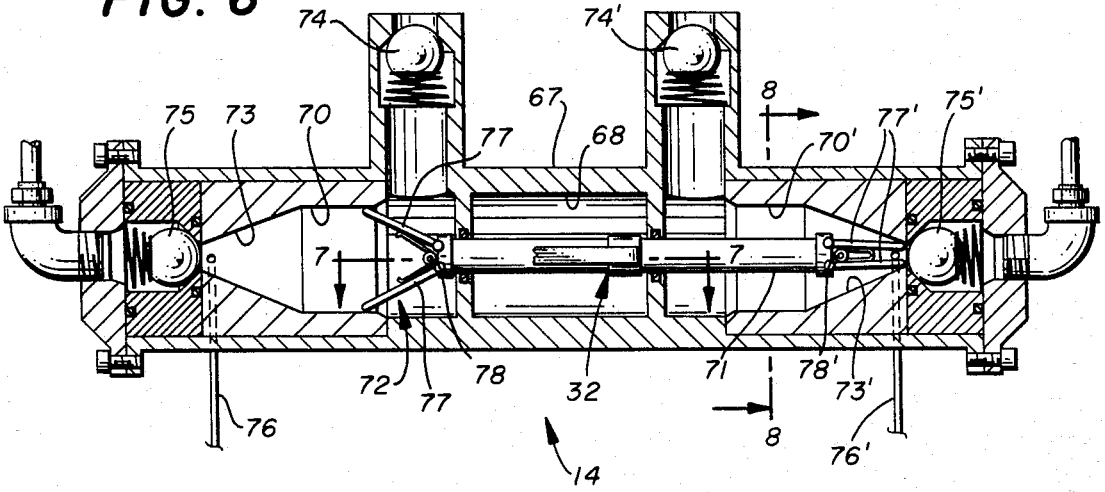
FIG. 6 is an enlarged, longitudinal, part cross-sectional view taken along line 6—6 of FIG. 5.
Figure 7:
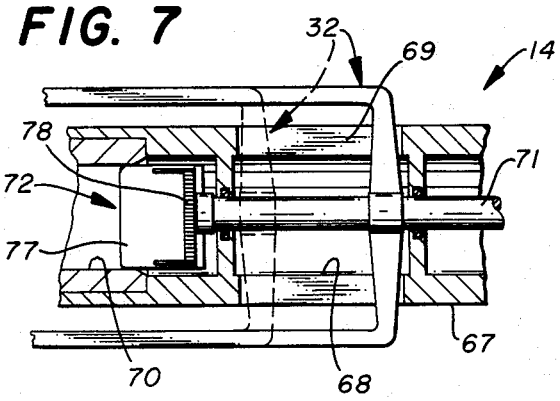
FIGS. 7 and 8; respectively; are cross-sectional views taken along line 7—7 and 8—8 of FIG. 6; respectively.
Figure 8:
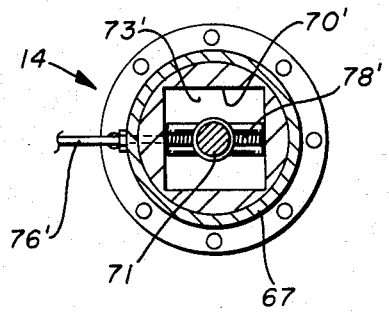

The purpose of the recycling mechanism 23 is to reposition the operating mechanism in the event the combustion process failed to properly stroke the combination engine and pump. With pistons 30 and 30' located as shown in FIG. 3, pump mechanism 14 will be in the position as shown in FIG. 6. Upon activation of the appropriate solenoid of mechanism 23 by time delay 64' the hydraulic valve in mechanism 23 will be rotated in a counterclockwise direction allowing pressure oil from accumulator to enter conduit line 76' and introduce pressure oil into the pump chamber formed by pump vanes 77', for example, located on the right hand section of the pump 14. In order for this oil to stroke the pumping mechanism of pump 14 and the power mechanism of engine 12 to the opposite position shown, the oil in chamber 70 must be permitted to return to the system reservoir under reduced pressure. As the hydraulic valve in mechanism 23 is rotated, flow line 76 is connected to a return line which leads to the system reservoir.

As indicated above, time delay switch 61' is activated by the secondary coil of solenoid 62'. This secondary coil is activated by current flowing through the primary coil and to contact points 39', thereby causing contact points 63' to close. As star wheel 57' is rotated, contact points 39' are opened, thereby deenergizing the primary coil of solenoid 62'. Contact points 63' will remain closed, however, due to the magnetic attraction of the armature of the energized secondary coil being in close proximity to the armature of the primary coil.

As the recycling mechanism moves the complete power mechanism is the opposite direction, power yoke 32 is also moved. Movement of yoke 32 permits contact points 64 to open as the cam situated on this yoke is moved. Opening of points 64 de-energizes the secondary coil of solenoid 62', allowing the solenoid spring to release the time delay switch 61', thereby interrupting the flow of current to the appropriate solenoid of the recycling mechanism. Unless otherwise prevented from doing so, the solenoid spring will return the hydraulic valve to the neutral position, and cut off the flow of power oil before the cycle is complete. To prevent this premature closing, there is provided the illustrated two spring loaded detent mechanisms which are built into the housing of the valve. There are two depressions machined into the rotor of the valve which are positioned in such a manner that when the valve is shifted in either direction away from neutral into a power position one of the depressions is aligned with one of the detents. The valve rotor includes passageways connecting the depressions to the accumulator oil pressure. As the valve is shifted, the plunger of one of the detents is forced into the depression by the detent spring. The tension of this spring is such that once the plunger has entered the depression, a hydraulic oil pressure of 1900 psi is required to raise the plunger out of the depression. Engagement of the detent prevents the solenoid spring from returning the valve to the neutral position until the detent is disengaged. Shifting of the power mechanism requires approximately 1000 psi of hydraulic pressure. This valve is constructed in such a manner that oil can leave the valve faster than it can enter; and this may be accomplished by placing an orifice on the inlet side, for example. Therefore, when the valve is shifted to the operating position the operating mechanism is shifted by the 1000 psi pressure; however, as the mechanism reaches the end of its travel, the oil pressure will raise to accumulate pressure in excess of 1900 psi whereupon the detent plunger is forced out of the depression, allowing the solenoid spring to return the valve to a neutral position. The recycling mechanism may be manually operated by energizing either solenoid by a separate switch manually operated.

I claim:

1. A system for efficiently converting hydrocarbons into work comprising the combination of an internal combustion engine, a hydraulic pump, and a hydraulic motor;

means by which said internal combustion engine is connected to drive said hydraulic pump;

a system oil reservoir; a power oil accumulator; said hydraulic motor having a power oil inlet connected to said power oil accumulator and a power oil outlet connected to said system oil reservoir;

an auxiliary hydraulic pump means connected to said accumulator for increasing the pressure therein to a predetermined value, when the pressure is reduced below said value; and means connected to said power oil accumulator, said system oil reservoir, and said auxiliary hydraulic pump for cycling said engine into position for delivering a power stroke, whenever said engine fails to deliver a power stroke upon demand;

said hydraulic motor having a rotor journaled for axial rotation within a housing, vanes reciprocatingly received within and radiating from the rotor; means by which said power oil inlet and said power oil outlet convey power oil to and from the interior of the housing; and a variable enclosure means circumferentially positioned about said vanes;

said variable enclosure means froms a peripheral wall surface against which the outer ends of the vanes bear, and which is movable from a low power cylindrical configuration into a high power elliptical configuration.

2. The combination set forth in claim 1, wherein said variable enclosure means comprises two opposed members having facing concave sidewalls movable towards one another and into simultaneous engagement with a plurality of the vanes, to thereby reduce the displacement of the motor to a minimum.

3. The combination of claim 2 wherein said opposed members are slidably positioned within the housing and include synchronizing means by which each member is maintained equally spaced from the rotors.

4. The combination of claim 3 wherein the opposed members have an inside circumferentially extending face which jointly extends about the outer periphery of the rotor to enclose the vanes when the members are in a low power output configuration; the adjacent, opposed, marginal terminal ends of each member are of a configuration to be slidably received within said housing and in attached relationship respective to said synchronizing means.

5. The combination of claim 4 wherein said vanes have an outer marginal end of a radius which is substantially simultaneously tangential to both said housing and the inside face of said members as the vanes rotate from engagement with said housing into engagement with said members.

6. The combination of claim 1 wherein said rotor has a multiplicity of radial spaced vane receiving slots formed therein, with said vanes being received therein;

wherein said variable enclosure means comprises two opposed members having facing concave sidewalls movable towards one another and simultaneously engage a plurality of the vanes, to thereby reduce the displacement of the motor to a minimum when the members are closely adjacent to the rotor;

said opposed members are slidably positioned within the housing and include synchronizing means by which each member is maintained equally spaced from the rotor;

the opposed members have an inside circumferentially extending face which jointly extends about the outer periphery of the rotor to enclose the vanes when the members are in a low power output configuration;

the opposed marginal terminal ends of each member are of a configuration to be slidably received within said housing and in attached relationship respective to said synchronizing means; and means forming a power fluid inlet passageway within said members on the side adjacent said housing which enables the motor to be throttled by the reciprocal movement of said members.

7. A system for efficiently converting hydrocarbons into work comprising an internal combustion engine operatively connected to a hydraulic pump; a hydraulic reaction device;

a system oil reservoir connected to receive oil from said hydraulic reaction device; a power oil accumulator connected to supply oil to said hydraulic reaction device; said hydraulic pump having a power oil outlet connected to said power oil accumulator and a power oil inlet connected to said system oil reservoir;

an auxiliary hydraulic pump means connected to said power oil accumulator for increasing the pressure therein to a predetermined value, when the pressure is reduced below said value; and means connected to said power oil accumulator, said system oil reservoir, and said auxiliary hydraulic pump means for cycling said engine into position for delivering a power stroke, whenever said engine fails to deliver a power stroke upon demand;

said hydraulic reaction device having a main housing, a rotor journaled for axial rotation in sealed relationship within said housing;

a plurality of vane receiving slots formed radially about said rotor, a vane reciprocatingly received within each slot; a power oil inlet and outlet connected to exchange work with power oil which may be in contact with said vanes;

means forming an expansible chamber on opposed sides of the rotor and within said housing, means for varying the displacement of said expansible chamber so that the flow of power oil therethrough can be varied from a low flow to a high flow rate.

8. The system of claim 7, wherein said variable enclosure means comprises two opposed members having facing concave sidewalls movable towards one another and into simultaneous engagement with a plurality of the vanes, the thereby reduce the displacement of the motor to a minimum.

9. The system of claim 7 wherein said opposed members are slidably positioned within the housing and include synchronizing means by which each member is maintained equally spaced from the rotors.

10. The system of claim 7 wherein the opposed members have an inside circumferentially extending face which jointly extends about the outer periphery of the rotor to enclose the vanes when the members are in the low flow configuration;

a synchronizing means for said members; the opposed marginal terminal ends of each member are of a configuration to be slidably received within said housing and mounted in attached relationship respective to said synchronizing means.

11. The system of claim 7 wherein said vanes have an outer marginal end of a radius which is substantially simultaneously tangential to both said housing and the inside face of said members as the vane rotates from engagement with said housing into engagement with said members.

12. The system of claim 7 wherein said variable enclosure means comprises two opposed members having facing concave sidewalls movable towards and away from one another and into simultaneous engagement with an opposed plurality of the vanes, to thereby reduce the displacement of the motor to a minimum when the members are moved closely adjacent to said rotor, and vice versa;

said opposed members are slidably positioned within the housing and include synchronizing means by which each member ia maintained equally spaced from the rotors;

the opposed members include an inside circumferentially extending face which jointly extends about the outer periphery of the rotor to bear against the outer edge of the vanes;

the opposed marginal terminal ends of each member are of a configuration to be slidably received within said housing and in attached relationship respective to said synchronizing means;

and means forming a passageway adjacent said housing by which power fluid through the reaction device is throttled by the reciprocal movement of said members.

13. A system for generating high pressure fluid comprising an internal combustion engine having a cylinder, a double acting piston reciprocatingly received in sealed relationship within said cylinder; a combustion chamber formed at each end of said cylinder on each opposed side of said double action piston; intake valve means by which a combustible mixture of fuel and air is emitted into said combustion chamber, and exhaust valve means by which spent combustion gases are exhausted from the combustion chamber;

a fluid pump device having a pump piston means; means connecting said double acting piston to said pump piston so that the fluid pump piston reciprocates in response to reciprocation of said double acting piston; a fluid accumulator within which power fluid can be accumulated by the action of said pump piston;

a source of combustion air, a source of combustion fuel, and means connected to said double acting piston and to said air and fuel source by which a combustible mixture is delivered through the intake valve means in proper timed relationship respective to the position of said double acting piston;

means by which combustion within said combustion chamber is initiated whenever the fluid pressure within the accumulator reaches a predetermined minimum value, and means connected between said engine and said pump for reciprocating said double acting piston into a position to deliver a power stroke in the event of combustion failure.

14. The system of claim 13 wherein said source of combustion air is maintained at a pressure of several atmospheres, said source of air is supplied to said intake valve means by a fluid actuated air compressor;

said fluid actuated air compressor includes a hydraulically actuated compressor cylinder, said cylinder is arcuate and includes a fixed end and a reciprocating end, a compressor piston hinged to said reciprocating end, means by which said compressor piston is pivotally connected to be pivotally actuated within the arcuate compressor cylinder, said piston, hinge, and hydraulic cylinder being arranged respective to one another whereby a mechanical advantage of increasing magnitude is achieved as the hydraulically actuated cylinder strokes the piston and forces air to be compressed and transferred into the source of combustion air.

15. The system of claim 13 wherein said source of fuel is an injector pump, said pump includes linkage means by which it is actuated in response to reciprocation of said engine piston;

means by which said injector pump delivers a predetermined quantity of fuel into each of the combustion chambers in timed sequence respective to the reciprocating piston.

16. The system of claim 13 wherein there is included auxiliary pump means for increasing the fluid pressure within said accumulator; timing means connected to be actuated when the system is energized so that should power from the engine be demanded and the engine fails to deliver a power stroke, said timing means, after a predetermined time interval, will provide pressurized fluid from said accumulator to the pump in a manner to properly position the engine piston for a power stroke.

17. The system of claim 13 wherein said fluid pump device is a hydraulic motor having a rotor journaled for axial rotation within a housing, vanes reciprocatingly received within and radiating from the rotor; a fluid inlet and a fluid outlet attached to convey fluid to and from the interior of the housing; said rotor, housing, and vanes are provided with a variable enclosure means circumferentially positioned about said vanes;

said variable enclosure means forms a peripheral wall surface against which the outer ends of the vanes bear, and which is movable from a low power cylindrical configuration into a high power eliptical configuration.

18. A system for efficiently converting hydrocarbons into work comprising an internal combustion engine operatively connected to a hydraulic pump;

a system oil reservoir connected to supply oil to said pump; a power oil accumulator connected to receive oil from said pump; a hydraulic motor having a power oil inlet connected to said accumulator and a power oil outlet connected to said reservoir;

an auxiliary hydraulic pump means connected to said accumulator for increasing the pressure therein to a predetermined value, when the pressure is reduced below said value; and means connected to said accumulator, said reservoir, and said pump for cycling said engine into position for delivering a power stroke, whenever said engine fails to deliver a power stroke upon demand.

19. The system of claim 18 and further including a fluid actuated pump for delivering combustion air to said internal combustion engine;

said fluid actuated pump includes a hydraulically actuated cylinder having a fixed end and a reciprocating end, a compressor piston hinged to said reciprocating end, means by which said piston is pivotally connected to be pivotally actuated within an arcuate cylinder, said piston, hinge, and hydraulic cylinder being arranged respective to one another whereby a mechanical advantage of increasing magnitude is achieved as the hydraulically actuated cylinder strokes the piston and forces air to be compressed and transferred into the source of combustion air.

20. The system of claim 18 wherein said hydraulic motor includes a rotor journaled for axial rotation within a housing, vanes reciprocatingly received within and radiating from the rotor; a fluid inlet and a fluid outlet attached to convey power fluid to and spent power fluid from the interior of said housing so that work is exchanged between the power fluid and rotor, a variable enclosure means circumferentially positioned about said vanes;

said variable enclosure means forms a peripheral wall surface against which the outer ends of the vanes bear, and which is movable from a lower power cylindrical configuration into a high power eliptical configuration.

21. The sytstem of claim 18 and further including a fuel injector pump for said internal combustion engine;

said injector pump has a housing, a cylinder in said housing within which a piston reciprocates, said cylinder is open at one end thereof for reciprocatingly receiving a piston which is connected to be reciprocated by said internal combustion engine;

the other end of said cylinder is connected to means by which the cylinder is moved axially toward and away from said piston in order to adjust the fuel flow delivered by said injector to enable said cylinder to receive a shaft therewithin, said shaft being affixed to the injector housing and having a free end spaced from the free end of said piston;

an inlet chamber formed about the marginal free end of said cylinder, a port through which fuel can flow into said cylinder at a location between the end of said shaft and the end of said piston;

so that when said cylinder is moved respective to said fixed shaft, said port moves respective to the free end of said piston and the free end of said shaft thereby changing the quantity of fuel delivered as said piston strokes.

22. The system of claim 18 wherein said means for positioning said engine includes said hydraulic pump, a piston within said pump is connected to a piston within said engine, timer means energized whenever work is demanded from said engine, means connected to said pump and to said accumulator by which said pump piston forces said engine piston into proper position for a power stroke whenever the timer means times out;

and means for interrupting the action of the timer means in the event combustion occurs and the engine delivers power prior to the timer timing out.

23. The system of claim 22 and further including a fluid actuated pump which delivers the combustion air to a source for said internal combustion engine;

said fluid actuated pump includes a hydraulically actuated cylinder having a fixed end and a reciprocating end, a compressor piston hinged to said reciprocating end, means by which said piston is pivotally connected to be pivotally actuated within an arcuate compression cylinder, said piston, hinge, and hydraulic cylinder being geometrically arranged respective to one another whereby a mechanical advantage of increasing magnitude is derived as the hydraulically actuated cylinder strokes the compression piston and forces air to be compressed and transferred into the source of combustion air;

a hydraulic motor connected to receive power oil from said accumulator;

said hydraulic motor includes a rotor journaled for axial rotation within a housing, vanes reciprocatingly received within and radiating from the rotor; a fluid inlet and a fluid outlet attached to convey power fluid to and spent power fluid from the interior of the housing; a variable enclosure means circumferentially positioned about said vanes;

said variable enclosure means forms a peripheral wall surface against which the outer ends of the vanes bear, and which is movable from a low power cylindrical configuration into a high power eliptical configuration.

24. The system of claim 18 wherein said hydraulic pump comprises a main housing forming a working chamber therewithin; spaced pistons connected together and to said engine by a common shaft;

each piston being mounted to opposed ends of said shaft and reciprocatingly received within said chamber;

means sealingly receiving said shaft and thereby providing opposed chambers within which said pistons force power oil to said accumulator;

each said chamber having a relatively large marginal end which converges into a relatively small marginal end, each said piston having a piston wall which conforms to the general cross-sectional area of said chamber as said piston is reciprocated by said engine; so that, as said piston forces oil from the chamber, the initial power required to move the piston is proportional to the force or work required in moving the oil from the chamber into the reservoir.

25. The system set forth in claim 24 and further including a fluid actuated pump for delivering combustion air to said internal combustion engine;

said fluid actuated pump includes a hydraulically actuated cylinder having a fixed end and a reciprocating end, a compressor piston hinged to said reciprocating end, means by which said piston is pivotally connected to be pivotally actuated within an arcuate cylinder, said piston, hinge, and hydraulic cylinder being arranged respective to one another whereby a mechanical advantage of increasing magnitude is achieved as the hydraulically actuated cylinder strokes the piston and forces air to be compressed and transferred into the source of combustion air.

26. The system of claim 18 wherein said internal combustion engine is provided with a double acting piston having a medial portion to which a yoke is connected so that said yoke can be connected to actuate said hydraulic pump;

said engine includes a cylinder within which said double acting piston is reciprocatingly received, with there being a combustion chamber formed at each opposed end of said cylinder;

means positioning said double acting piston within said cylinder so that a power stroke can subsequently occur, means providing a combustible mixture within said combustion chamber when said piston is positioned respective to said combustion chamber for a power stroke;

and means indirectly connected to said yoke for maintaining an exhaust valve opened on the exhaust stroke and closed on the power stroke.

27. The system of claim 26 wherein said hydraulic pump comprises a main housing forming a working chamber therewithin; spaced pistons connected together and to said engine by a common shaft;

each piston being mounted to opposed ends of said shaft and reciprocatingly received within said chamber;

means sealingly receiving said shaft and thereby providing opposed chambers within which said pistons force power oil to said accumulator;

each said chamber having a relatively large marginal end which converges into a relatively small marginal end, each said piston having a piston wall which conforms to the general cross-sectional area of said chamber as said piston is reciprocated by said engine; so that, as said piston forces oil from the chamber, the initial power required to move the piston is proportional to the force or work required in moving the oil from the chamber into the reservoir.

28. In an internal combustion engine of the double acting type, having an elongated cylindrical chamber which receives a double acting piston therewithin, and which includes a combustion chamber at each extremity of the cylinder so that the piston is forced to reciprocate as combustion within each of the chambers alternately occurs, and power transfer means connected to said piston and extending from said cylinder for extracting power from said engine, the improvement comprising:

a source of air under pressure, intake valve means connected to deliver air to each combustion chamber, said valve means is moved from an opened to a closed position in timed relationship respective to the piston to provide combustion air flow from said source to said combustion chambers;

exhaust valve means by which exhaust gases are exhausted from said combustion chamber in timed relationship respective to said double acting piston;

means for providing fuel admixed with said air in a manner to provide a combustible mixture within said combustion chambers;

ignition means connected to ignite a combustible mixture which may be contained within said combustion chamber when said double acting piston is properly positioned for a power stroke;

and means by which said double acting piston is forced into position for a power stroke whenever power is demanded from said engine.

29. The improvement of claim 28 wherein said means for positioning said double acting piston is a hydraulic pump having a piston therewithin connected to said power transfer means, timer means energized whenever work is demanded from said engine, accumulator means by which power fluid from said pump is accumulated, means connected to said pump and to said accumulator means by which said pump piston forces said engine piston into proper position for a power stroke whenever the timer means runs out;

and means for interrupting the action of the timer means in the event combustion occurs and the engine delivers power prior to the timer running out.

30. The system of claim 28 wherein said means by which said double acting piston is forced into position includes a hydraulic pump having a main housing forming a working chamber therewithin; spaced pistons connected together and to said engine by a common shaft;

each piston being mounted to opposed ends of said shaft and reciprocatingly received within said chamber;

means sealingly receiving said shaft and thereby providing opposed chambers within which said pistons force power oil to an accumulator;

each said chamber having a relatively large marginal end which converges into a relatively small marginal end, each said piston having a piston wall which conforms to the general cross-sectional area of said chamber as said piston is reciprocated by said engine; so that, as said piston forces oil from the chamber, the initial power required to move the piston is proportional to the force or work required in moving the oil from the chamber into the reservoir.

31. The improvement of claim 30 wherein there is included auxiliary pump means for increasing the fluid pressure within said accumulator; timing means connected to be actuated when the system is energized so that should power from the engine be demanded and the engine fails to deliver a power stroke, said timing means, after a predetermined time interval, will provide pressurized fluid from said accumulator to the pump in a manner to properly position the engine piston for a power stroke.

32. The improvement of claim 31 wherein said engine includes an injector which provides fuel within a combustion chamber each power stroke of the engine;

said injector pump has a housing, a cylinder in said housing within which a piston reciprocates, said cylinder is open at one end thereof for reciprocatingly receiving a piston which is connected to be reciprocated by said internal combustion engine;

the other end of said cylinder is connected to means by which the cylinder is moved axially toward and away from said piston in order to adjust the fuel flow delivered by said injector;

the other end of said cylinder receives a shaft therewithin, said shaft being affixed to the injector housing and having a free end spaced from the free end of said piston;

an inlet chamber formed about the marginal free end of said cylinder, a port through which fuel can flow into said cylinder at a location between the end of said shaft and the end of said piston;

so that when said cylinder is moved respective to said fixed shaft, said port moves respective to the free end of said piston and the free end of said shaft thereby changing the quantity of fuel delivered as said piston strokes.

33. The improvement of claim 29 and further including a hydraulic motor connected to receive power fluid from said pump.

34. The improvement of claim 33 wherein said combustion air is maintained at a pressure of several atmospheres, said air is supplied by a fluid actuated pump;

said fluid actuated pump includes a hydraulically actuated cylinder having a fixed end and a reciprocating end, a compressor piston hinged to said reciprocating end, means by which said piston is pivotally connected to be pivotally actuated within an arcuate cylinder, said piston, hinge, and hydraulic cylinder being arranged respective to one another whereby a mechanical advantage of increasing magnitude is achieved as the hydraulically actuated cylinder strokes the piston and forces air to be compressed and transferred into the source of combustion air.

35. A method of converting hydrocarbon fuel into work, comprising the step of:

forming opposed combustion chambers by reciprocatingly receiving a double acting piston within a cylinder;

forcing the double acting piston to move in one direction towards the end of its stroke, where the piston is held stationary at a first of said combustion chambers until power is required;

placing a combustible mixture within the first of said combustion chambers and igniting the mixture in response to demand for power; thereby forcing the piston to stroke to the opposite end of the cylinder;

exhausting spent gases from the first combustion chamber; and providing a combustible mixture within the second of said combustion chambers;

igniting the mixture contained within the second of said combustion chambers, thereby forcing the piston to reciprocate back to the first of said combustion chambers;

exhausting spent gases from the second of said combustion chambers;

igniting a combustible mixture in the first of said combustion chambers, and continuing to reciprocate the engine in the above described manner so long as power is demanded;

connecting a fluid pump to position the piston at the appropriate position for the engine to commence a power stroke;

using the work generated by the piston to provide a system pressure; and connecting said fluid pump to said system pressure and thereby force the fluid pump to move in a direction to force the piston into the recited position for a power stroke to occur upon combustion failure.

36. The method of claim 35 wherein the power output of the engine is used to provide power fluid according to the steps of:

supporting a rotor within a housing and mounting radial vanes in the rotor;

forming concave surfaces on confronting faces of opposed members which generally correspond to a segment of a circle having a circumference described by the outer edge of a rotating vane at one position of operation;

mounting said opposed members within said housing;

forming a variable expansion chamber on opposed sides of the rotor and within the main housing by moving the opposed curved members towards and away from the outer surface of said rotor thereby controlling the displacement of the reaction device;

flowing fluid into the housing at a location between said members so that fluid flows into said expansible chamber and thereby exchanges power between the rotor and the fluid.

37. The method of claim 36 and further including the step of moving said opposed members simultaneously towards one another while said concave surfaces are held in engagement with a plurality of the vanes, thereby reducing the displacement of the reaction device to a minimum.

38. The method of claim 37 and further including the step of synchronizing one member respective to the opposed member so that each of the members are maintained equally spaced from the rotor as the members move towards and away from one another.

39. The method of claim 38 and further including the step of forming a radius on each of the free ends of the vanes and arranging the leading and trailing edges of the curved members to cause the curved surface of the vane to simultaneously and tangentially bear against the inside surface of the housing and the curved surface of the member as the vane rotates from engagement with the housing into engagement with the curved surface, and vice versa.

40. A method of converting hydrocarbon fuel into work, comprising the steps of:

forming a combustion chamber by reciprocatingly receiving a piston within a cylinder;

forcing the piston to move in a direction towards the end of its stroke, where the piston is held stationary respective to said combustion chamber until power is required;

placing a combustible mixture within said combustion chamber and igniting the mixture in response to demand for power, thereby forcing the piston to stroke to the opposite end of the cylinder;

exhausting spent gases from said combustion chamber; and thereafter providing a new combustible mixture within said combustion chamber; and igniting the mixture contained within said combustion chamber, thereby forcing the piston to reciprocate within said cylinder to thereby deliver power until the demand for power has been satisfied, whereupon the piston is again held stationary until power is again required;

connecting a fluid pump to said piston and connecting said fluid pump to a fluid accumulator so that the pressure within the accumulator is elevated during the time the piston is being reciprocated by the combustion process;

using the stored energy of the fluid contained within the fluid accumulator for positioning the piston at the appropriate position for the piston to commence a power stroke; and, connecting the fluid accumulator to a hydraulic reaction device to thereby achieve the stated function of converting fuel into work.

41. The method of claim 40, and further including the steps of providing said hydraulic reaction device with a main housing which supports a rotor in journaled relationship within a housing, there being vanes received within radial slots formed within the rotor, and; exchanging work between the rotor and the fluid contained within said fluid accumulator by forming concave surfaces on confronting faces of opposed members which generally correspond to a segment of a circle having a circumference described by the outer edge of a rotating vane at one position of operation;

mounting said opposed members within said housing;

forming a variable expansion chamber on opposed sides of the rotor and within the main housing by moving the opposed curved members towards and away from the outer surface of said rotor thereby controlling the displacement of the reaction device;

flowing fluid into the housing at a location between said members so that fluid flows into said expansible chamber and thereby exchanges power between the rotor and the fluid.

42. The method of claim 41 and further including the step of moving said opposed members simultaneously towards one another while said concave surfaces are held in engagement with a plurality of the vanes, thereby reducing the displacement of the reaction device to a minimum.

43. The method of claim 42 and further including the step of synchronizing one member respective to the opposed member so that each of the members are maintained equally spaced from the rotor as the members move towards and away from one another.

44. The method of claim 43 and further including the step of forming a radius on each of the free ends of the vanes and arranging the leading and trailing edges of the curved members to cause the curved surface of the vane to simultaneously and tangentially bear against the inside surface of the housing and the curved surface of the member as the vane rotates from engagement with the housing into engagement with the curved surface, and vice versa.

* * * * *